US010739727B2

(12) United States Patent
Guo

(10) Patent No.: US 10,739,727 B2
(45) Date of Patent: Aug. 11, 2020

(54) WATCH WITH DOUBLE WATCH-SURFACE AND METHOD FOR DISASSEMBLING SAME

(71) Applicant: Jun-Liang Guo, Tainan (TW)

(72) Inventor: Jun-Liang Guo, Tainan (TW)

( * ) Notice: Subject to any disclaimer, the term of this patent is extended or adjusted under 35 U.S.C. 154(b) by 314 days.

(21) Appl. No.: 15/872,056

(22) Filed: Jan. 16, 2018

(65) Prior Publication Data

US 2018/0136610 A1 May 17, 2018

(30) Foreign Application Priority Data

Jan. 5, 2017 (TW) ..... 106103046 A

(51) Int. Cl.
*G04B 37/00* (2006.01)
*G04B 45/00* (2006.01)

(52) U.S. Cl.
CPC ..... *G04B 45/0076* (2013.01); *G04B 37/00* (2013.01); *G04B 37/0033* (2013.01); *G04B 37/0083* (2013.01)

(58) Field of Classification Search
CPC ..... G04B 45/0076; G04B 37/00; G04B 37/0008; G04B 37/0033; G04B 37/0041; G04B 37/0083; A44C 15/0025
See application file for complete search history.

(56) References Cited

U.S. PATENT DOCUMENTS 5,479,381 A * 12/1995 Goldenberg ..... G04B 19/23 224/175
2006/0018202 A1* 1/2006 Girardin ..... A44C 15/0025 368/281

FOREIGN PATENT DOCUMENTS

EP 2874022 A1 * 5/2015 ..... G04B 37/0041
FR 449533 A * 3/1913 ..... G04B 37/0083
JP 57196179 A * 12/1982 ..... G04B 37/0008

* cited by examiner

*Primary Examiner* — Blake A Tankersley

(57) ABSTRACT

A watch having a double watch-surface and a method for disassembling the double watch-surface are provided. The watch includes a casing, in which an abutting ring portion is convexly provided; a first watch-surface which is placed on the top of the abutting ring portion; a second watch-surface which is placed at the bottom of the abutting ring portion; an snapping ring, the inner ring of which is annularly provided with a pressing portion and a groove; and a transparent cover engaged onto the groove. The two snapping rings are respectively engaged with the top surface and the bottom surface of the casing. The snapping ring is disposed on the abutting ring portion through the plural engaging protrusions. The pressing portion is pressed against the first and second watch-surfaces. Through the adjusting and snapping assembly, effect of engaging and fixing the two snapping rings to the casing can be achieved.

7 Claims, 31 Drawing Sheets

Disassembly method of a watch structure

WATCH WITH DOUBLE WATCH-SURFACE AND METHOD FOR DISASSEMBLING SAME

BACKGROUND OF THE INVENTION

1. Field of the Invention

The invention relates to watches and more particularly to a watch having a double watch-surface and a method for disassembling the double watch-surface.

2. Description of Related Art

The conventional watch is most commonly composed of a casing, a watch-surface, a movement structure, a transparent cover, a back cover, a lug and a watchband configured to the lug. Watch can often be used to stand for a person's taste. Through the style of the watch, you can be aware of a lot of information such as a wearer's personality and preference and so on. For a more exquisite user, he may wear different watches on different occasions.

However, each watch is a unique design. If a user wants to show a different style, he/she needs to wear a different watch. Therefore, users may need to spend more money to buy different styles of watches. Furthermore, if watch is inadvertently damaged or needs maintenance, it needs to be repaired by disassembling the back cover. Different models have different ways of disassembly, which not only needs to use a lot of hand tools, but also fails to directly view the repair area because the watchband may block the vision of the repair specialist.

Moreover, if a user often travels to two different time zones, the watch-surface also often needs to be adjusted to local time. Although the movement is simple, it makes one feel a little disturbing. The above problems are the shortcomings that the creators have personally experienced. The creators have paid attention to the above problems for many years. Therefore, after constantly researches, a watch having a double watch-surface watch overcoming the above shortcomings is created.

SUMMARY OF THE INVENTION

It is therefore one object of the invention to provide a watch comprising a casing, the casing is protruded with an abutting ring portion with its center being a hollow portion; the abutting ring portion is provided with a receiving groove, which is provided with a convex portion; the two sides of the convex portion form two grooves and a through hole penetrating through the casing and the convex portion; the top and bottom surfaces of the casing are provided with a plurality of pressing protrusions arranged at equal distance, wherein one pressing protrusion is located above the receiving groove; an accommodating space is provided between the pressing protrusion and the abutting ring portion; a first watch-surface is placed on the top of the abutting ring portion, and the movement components on the first watch-surface are located in the hollow portion; a second watch-surface is placed on the bottom of the abutting ring portion, and the movement components on the second watch-surface are located in the hollow portion; an adjusting and snapping component is composed of an adjusting screw, an assembly connector, an H-shaped snapping member and an abutting screw; the assembly connector is convexly provided with an engaging portion and a threaded through hole, and is assembled to the through hole from the outside of the casing through the engaging portion; the adjusting screw is provided with an external thread portion and a hollow thread portion, and is screwed and assembled with the assembly connector from the outside of the casing; the external thread portion of the adjusting screw is protruded from the assembly connector; the H-shaped snapping member is provided with a threaded through hole and two raised portions on both sides, forming a recess in the middle of the two raised portions; the H-shaped snapping member is screwed to the external threaded portion of the adjusting screw; the abutting screw is screwed to the hollow threaded portion of the adjusting screw; through the forward rotation of the adjusting screw, the H-shaped snapping member can be moved toward the convex portion of the casing, so the two raised portions are attached to the two grooves; when the adjusting screw is reversely rotated, the two raised portions are away from the two grooves; when the H-shaped snapping member abuts against the abutting screw, movement stops; a snapping ring is downwardly provided with a flange, which is provided with a plurality of engaging protrusions arranged at equal distance; the flange is provided with a notch on both sides of one of the engaging protrusions; the inner ring of the snapping ring is annularly provided with a pressing portion and a groove; the transparent cover is engaged with the groove; the two snapping rings are respectively engaged with the top surface and the bottom surface of the casing; the snapping ring is disposed on the abutting ring portion through the plural engaging protrusions; the pressing portion is pressed against the first watch-surface and the second watch-surface to move the engaging protrusions and the two sides' notches of the snapping ring onto the convex portion and the two sides' grooves; the adjusting screw is forwardly rotated to make the H-shaped snapping member close to the convex portion, so that the two raised portions pass through the two notches of the snapping ring and attach to the two grooves; the engaging protrusions are located in the accommodating space between the convex portion and the pressing protrusion, and are also engaged in the recess of the H-shaped snapping member; and other plural engaging protrusions are all located under the plural pressing protrusions, achieving the effect of engaging and fixing the two snapping rings to the casing.

The above and other objects, features and advantages of the invention will become apparent from the following detailed description taken with the accompanying drawings.

DETAILED DESCRIPTION OF THE INVENTION

Figure 1:
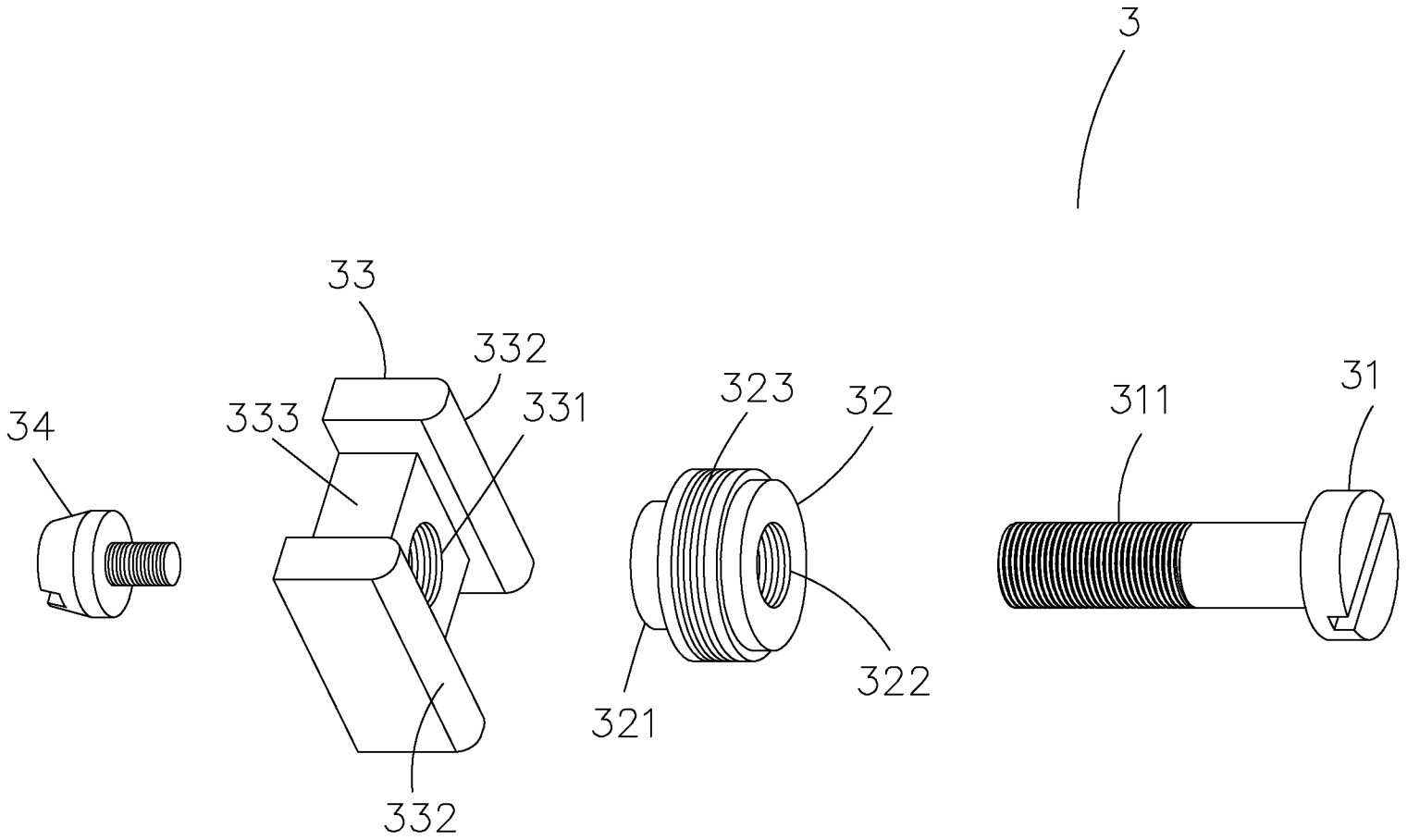
FIG. 1 is a perspective exploded view of the adjusting and snapping assembly of the invention.
Figure 2:
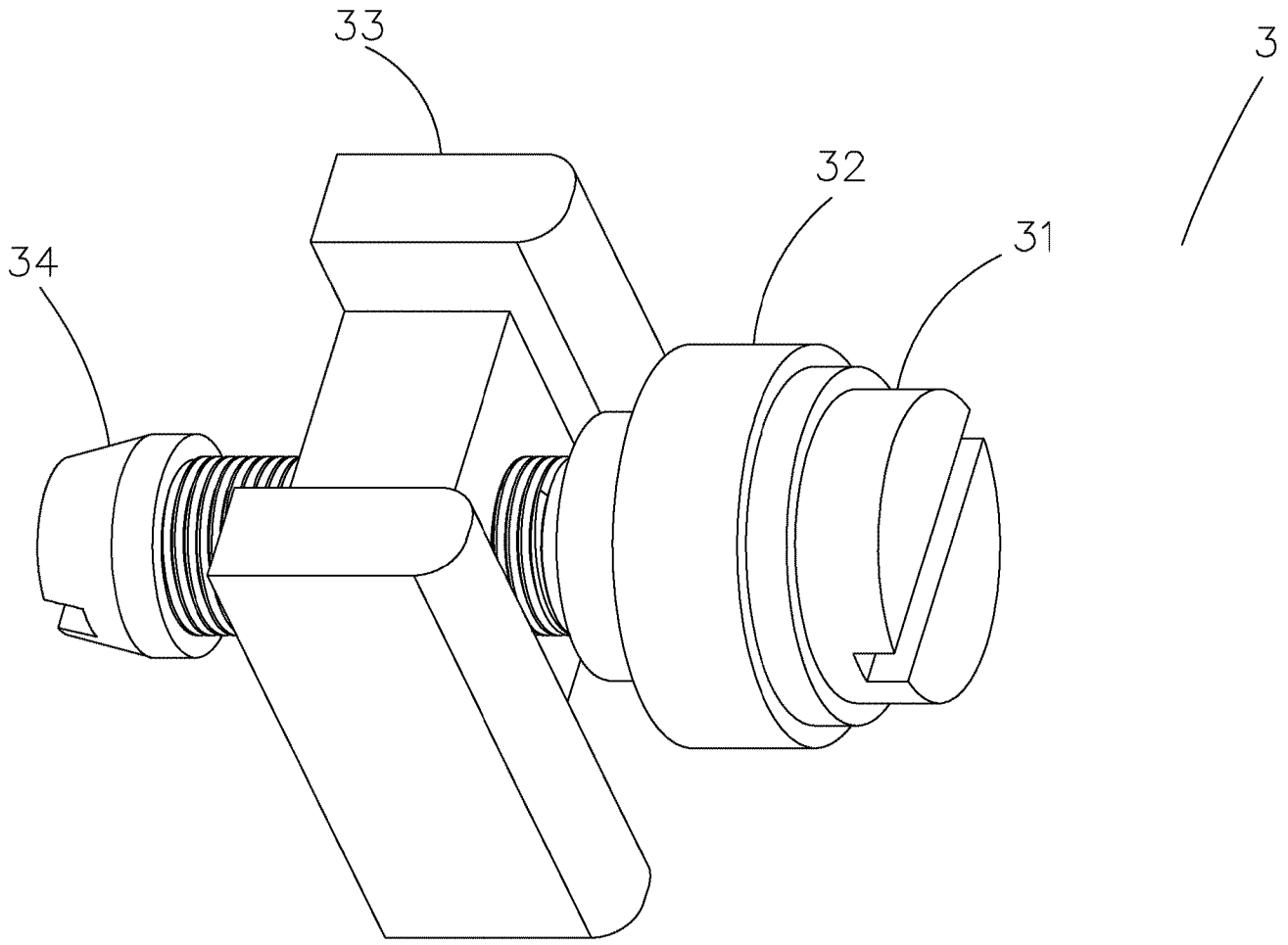
FIG. 2 is a perspective assembly view of the adjusting and snapping assembly.
Figure 3:
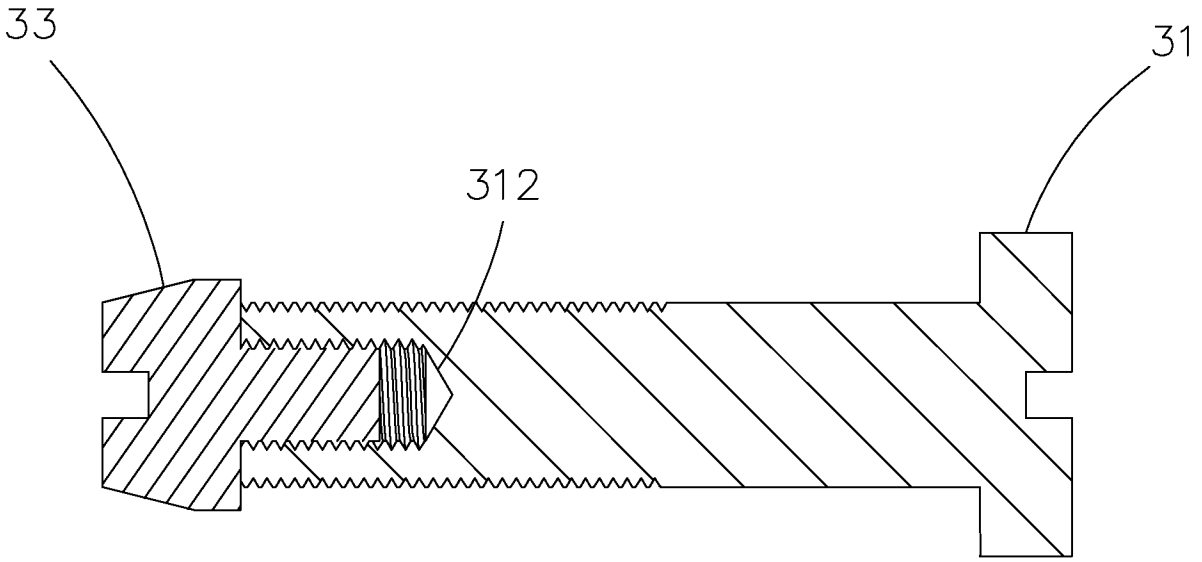
FIG. 3 is a cross-sectional view of the adjusting screw and the abutting screw assembly.
Figure 4:
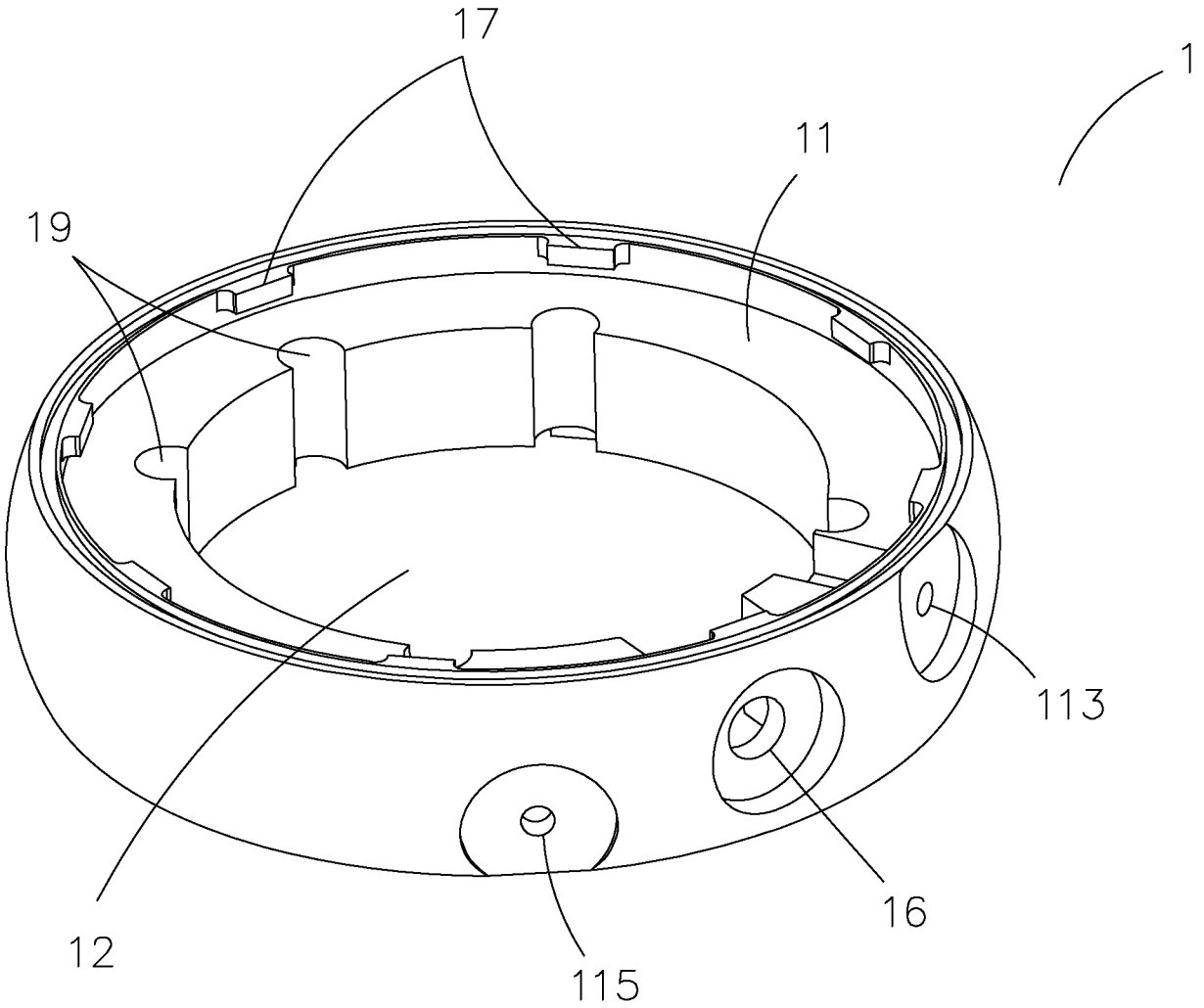
FIG. 4 is a perspective view of the casing.
Figure 5:
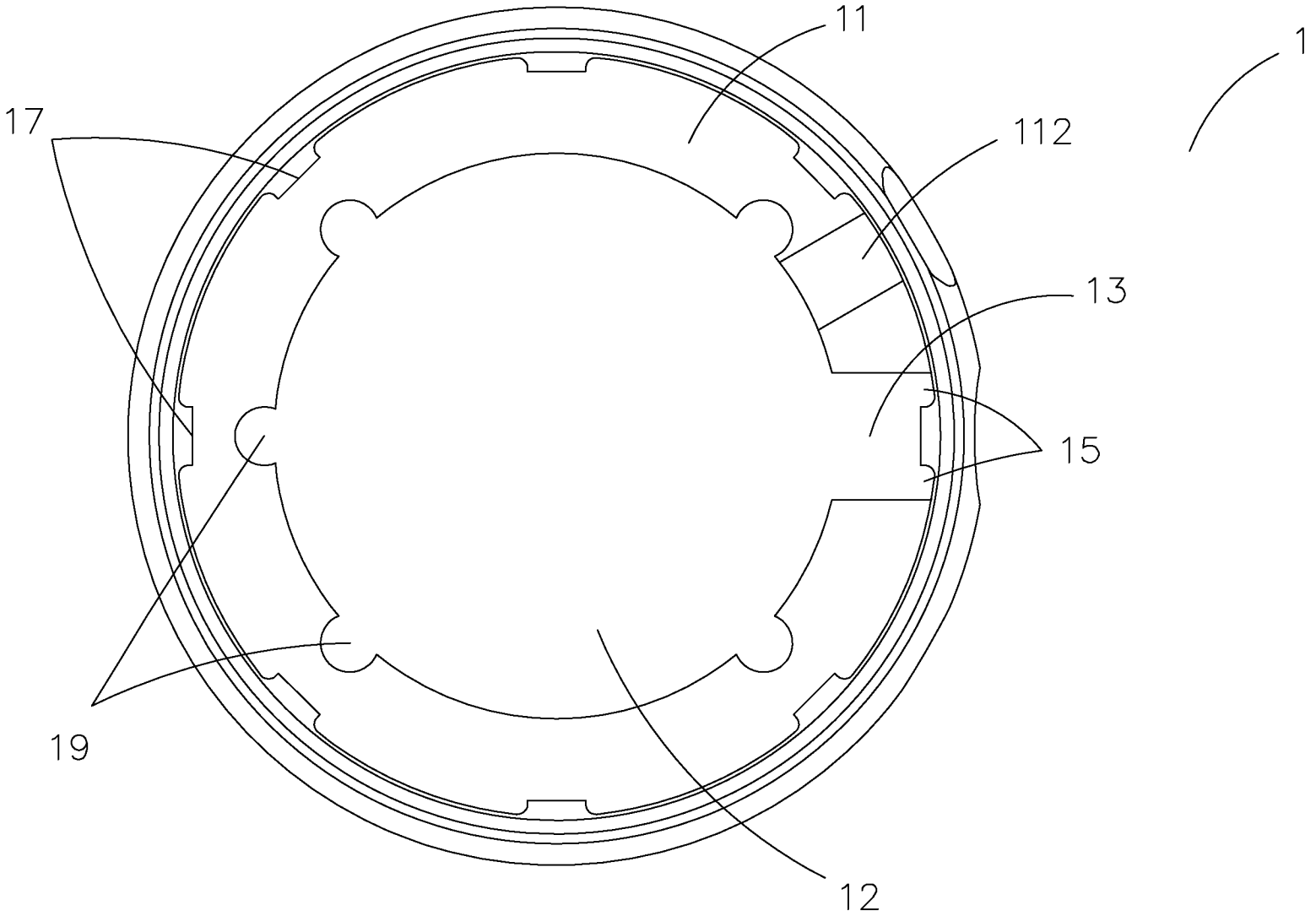
FIG. 5 is a top view of the casing.
Figure 6:
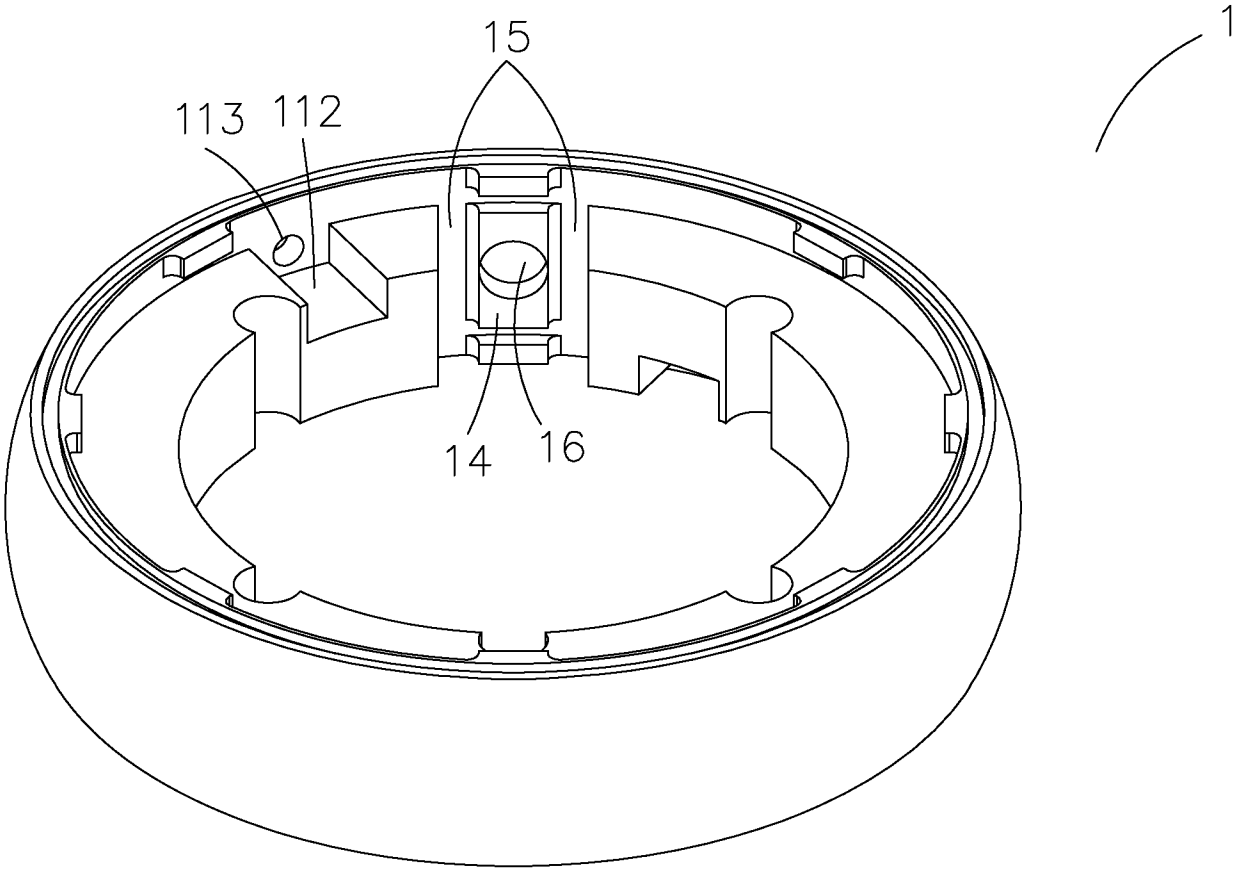
FIG. 6 is a perspective view of the casing from another angle.
Figure 7:
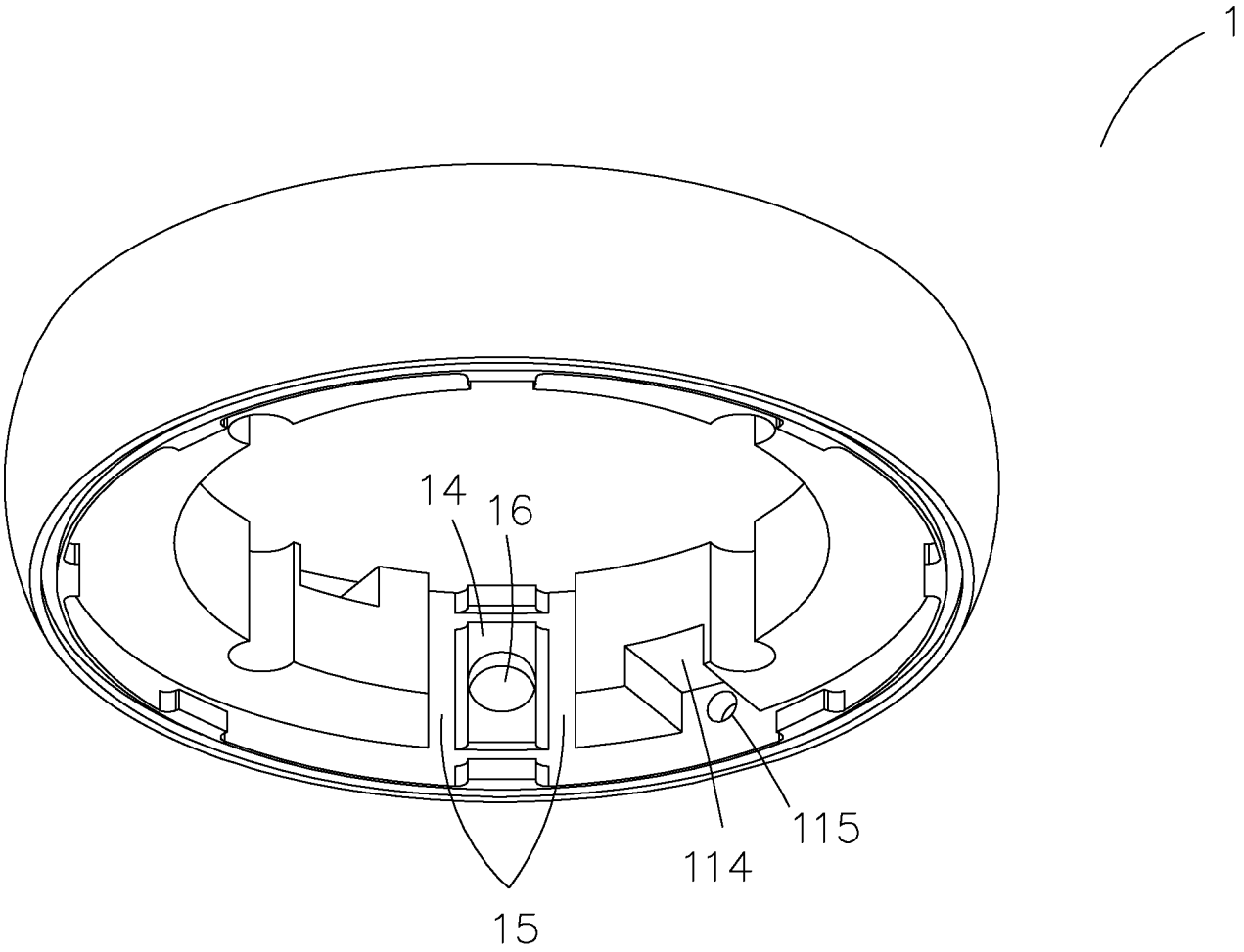
FIG. 7 is a perspective view of the casing from another angle.
Figure 8:
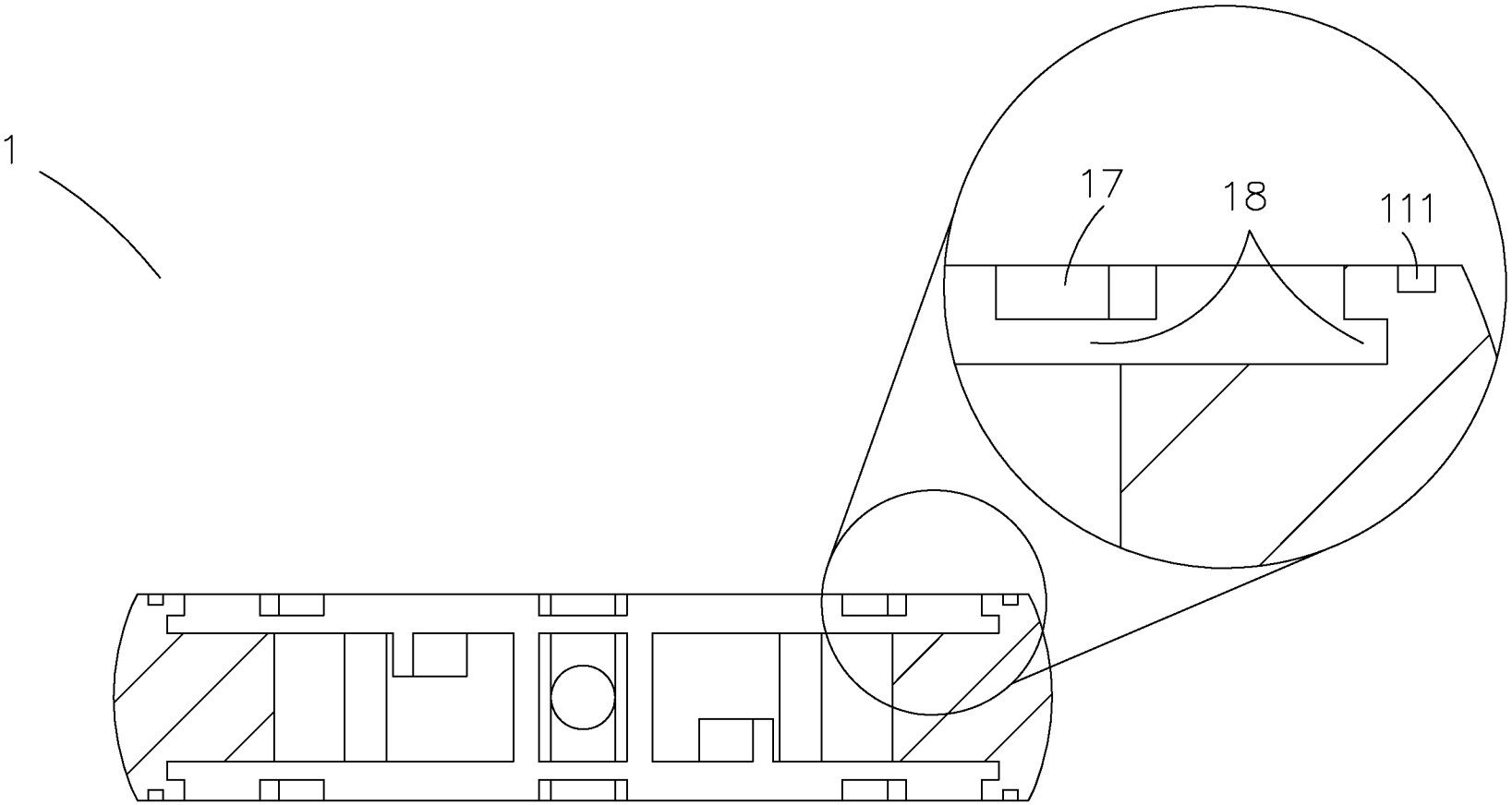
FIG. 8 is a cross-sectional view of the casing.
Figure 9:
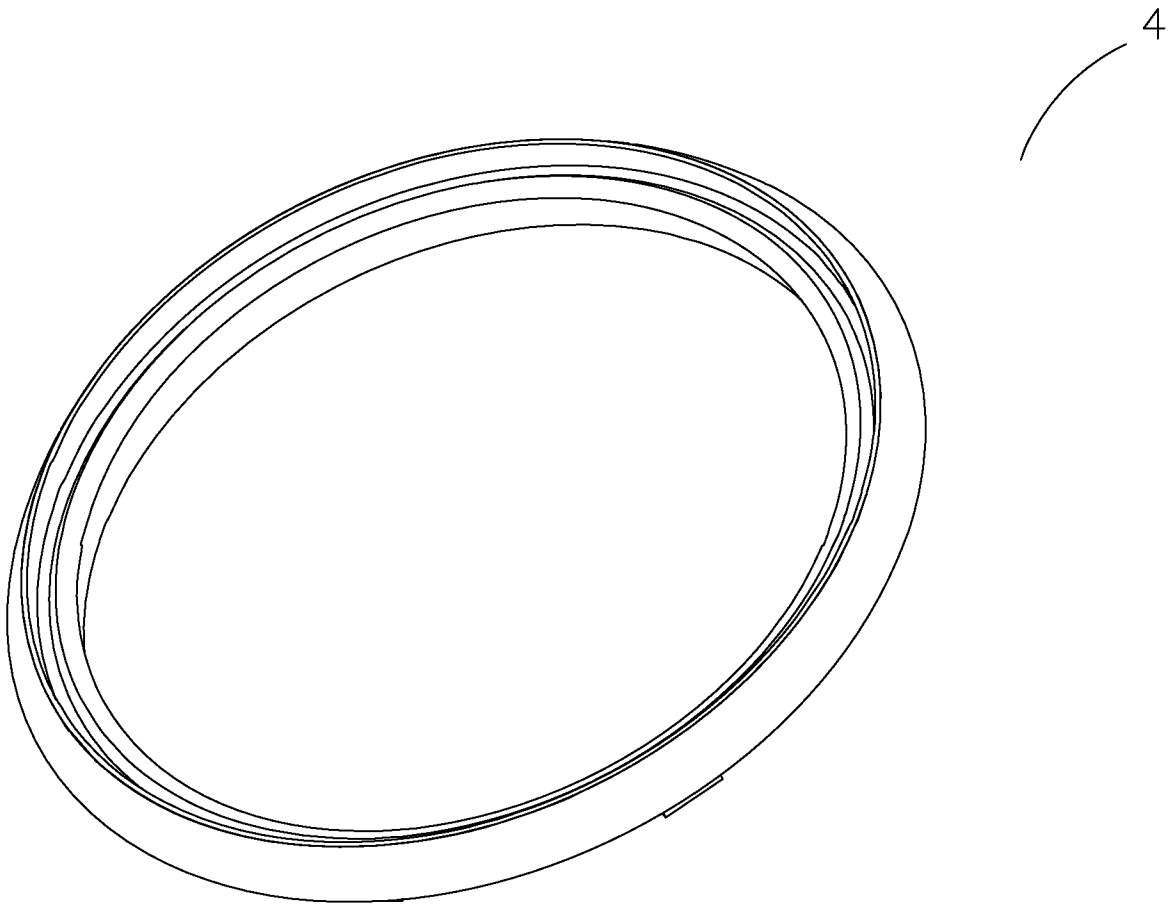
FIG. 9 is a perspective view of the snapping ring.
Figure 10:
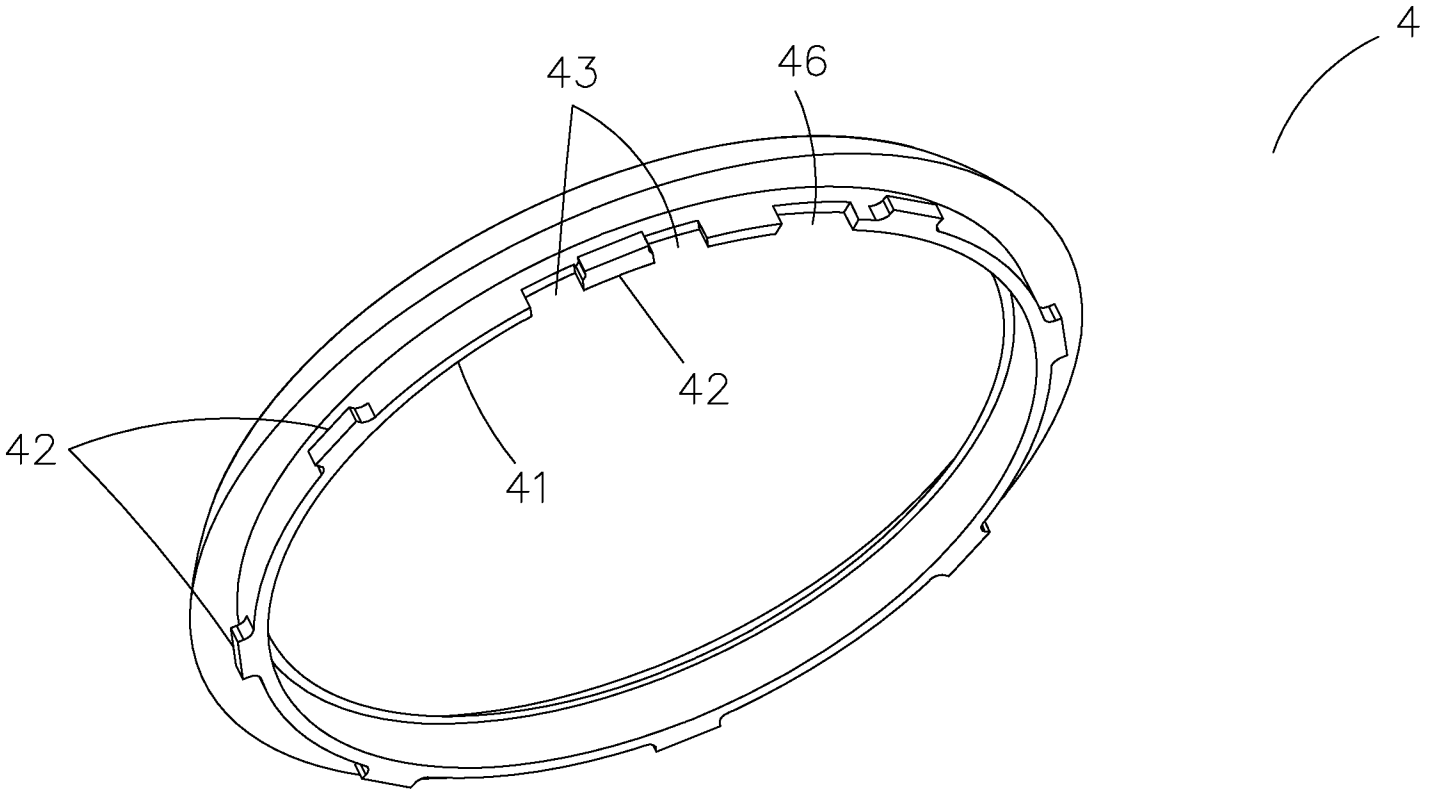
FIG. 10 is a perspective view of the snapping ring from another angle.
Figure 11:
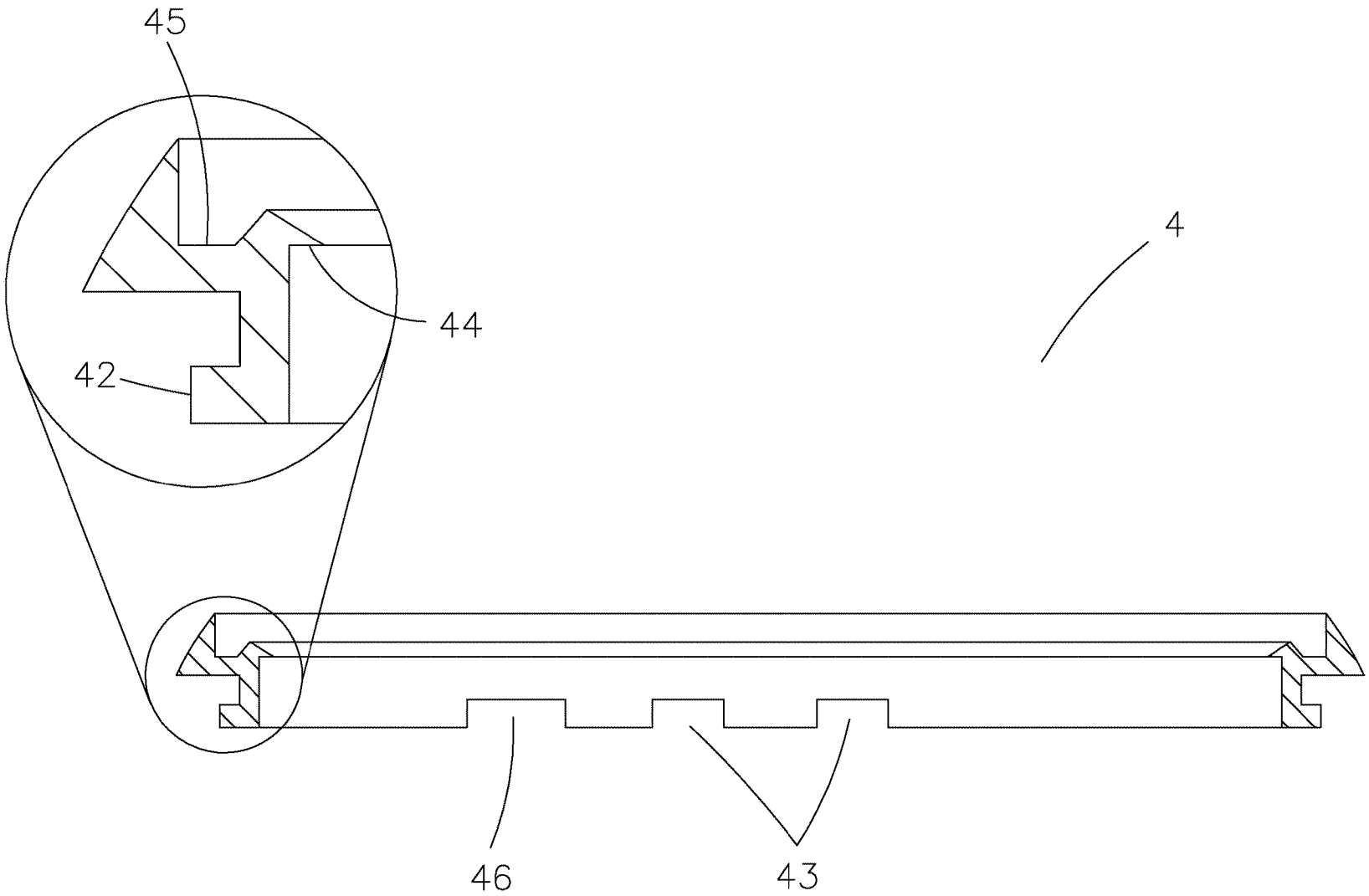
FIG. 11 is a cross-sectional view of the snapping ring.
Figure 12:
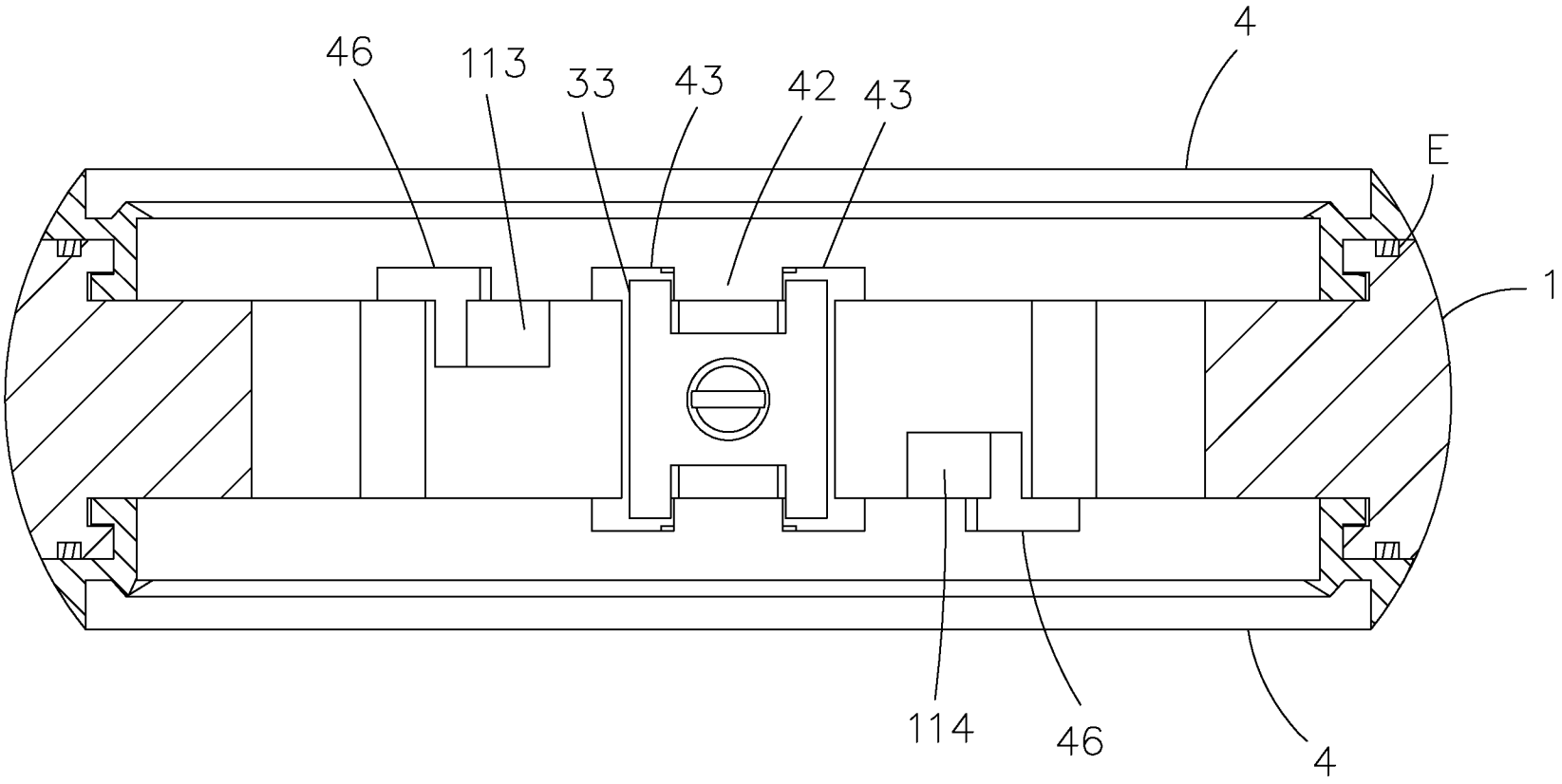
FIG. 12 is a cross-sectional view of the embodiment of the casing and the snapping ring assembly (1).
Figure 13:
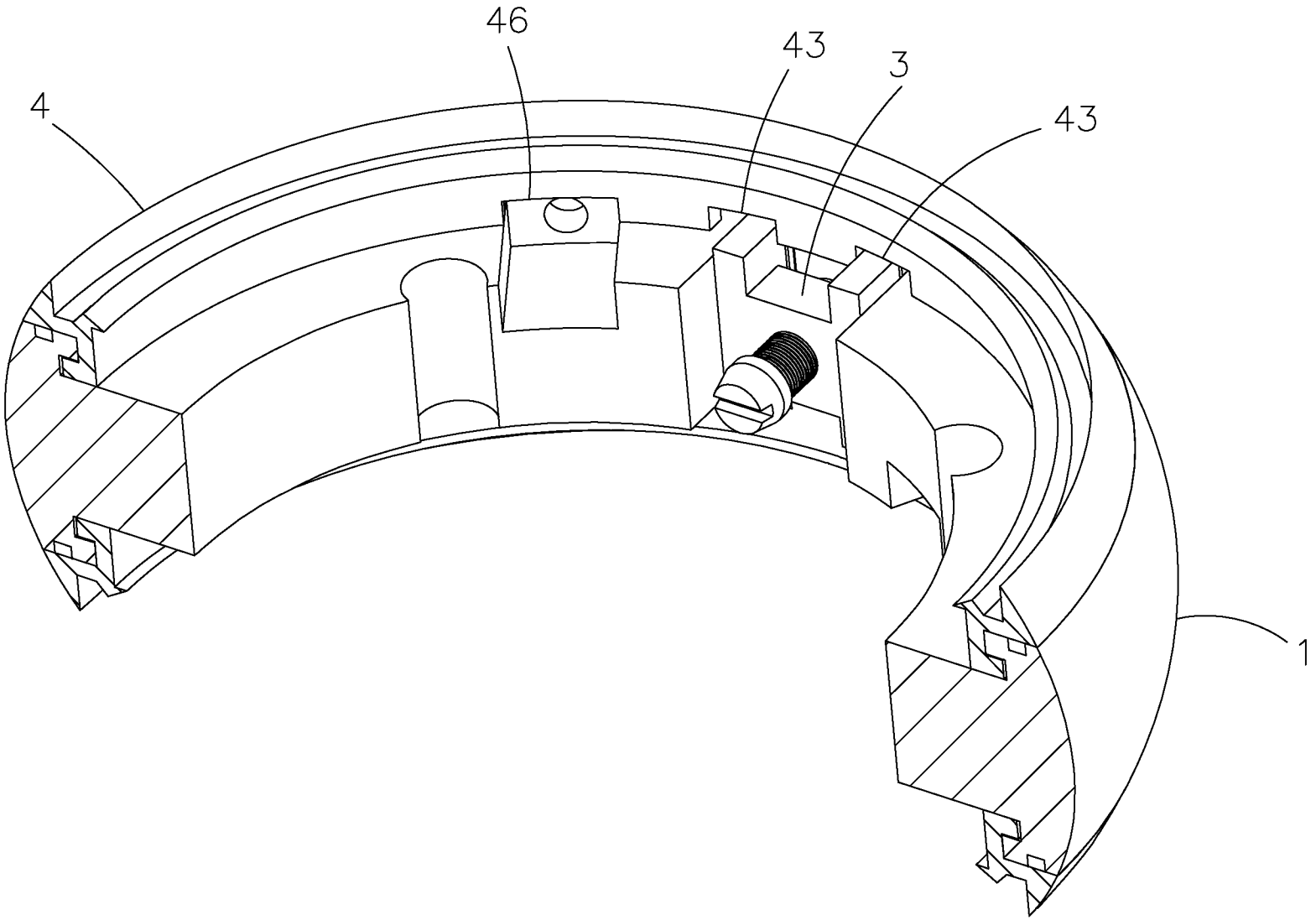
FIG. 13 is a cross-sectional view of the embodiment of the casing and the snapping ring combination (2).
Figure 14:
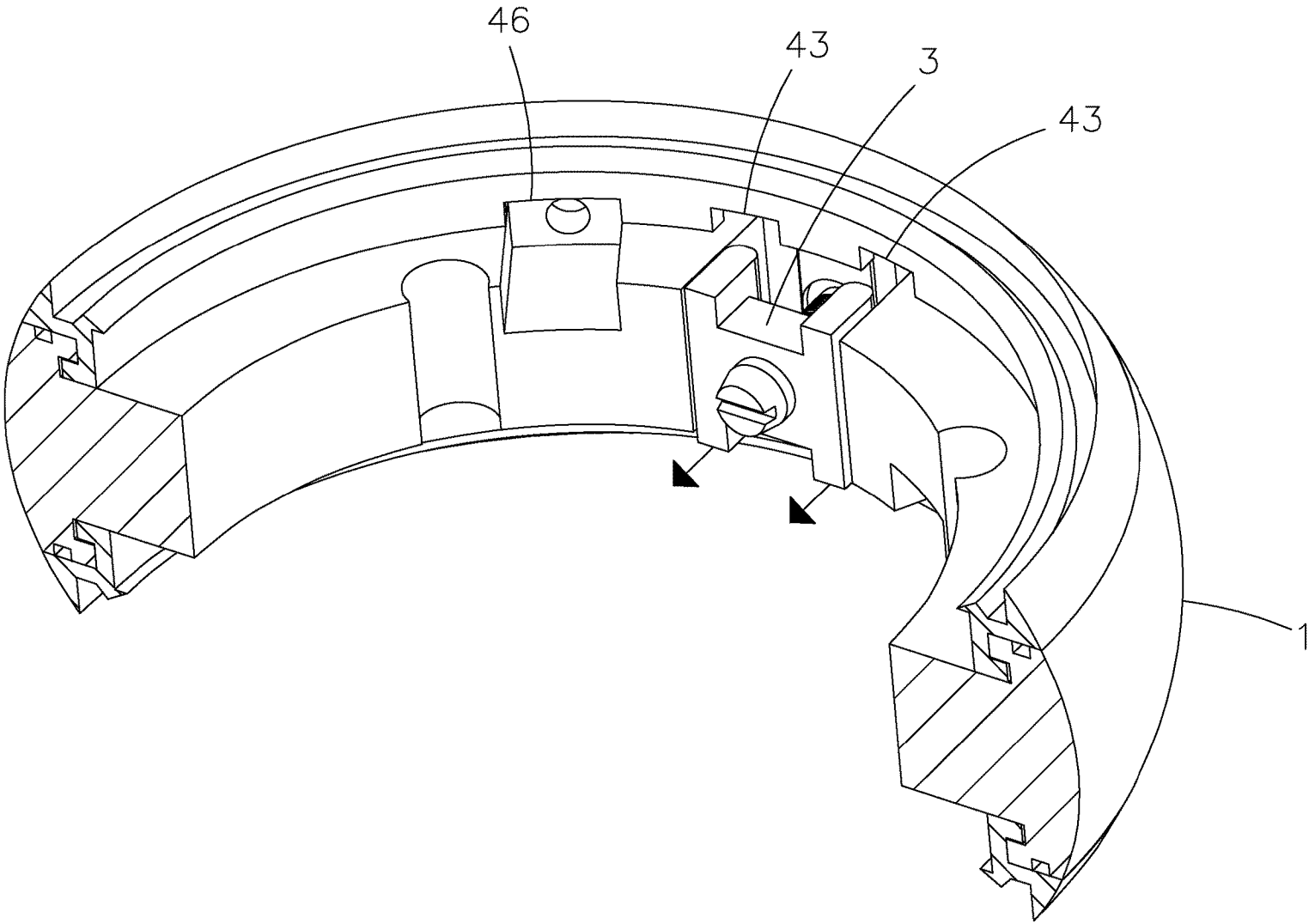
FIG. 14 is a cross-sectional view of the embodiment of the casing and the snapping ring assembly (3).
Figure 15:
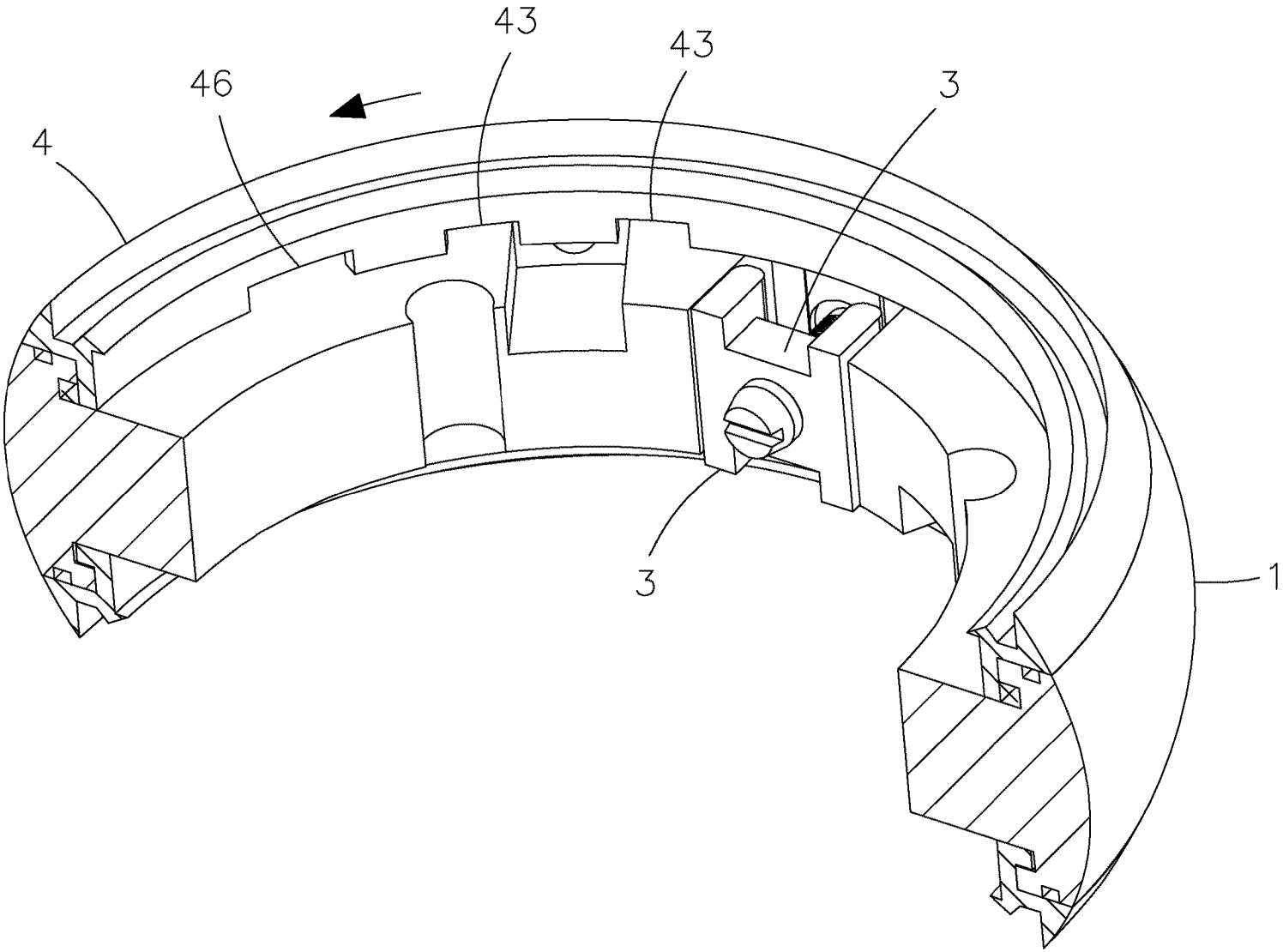
FIG. 15 is a cross-sectional view of the embodiment of the casing and the snapping ring assembly (4).
Figure 16:
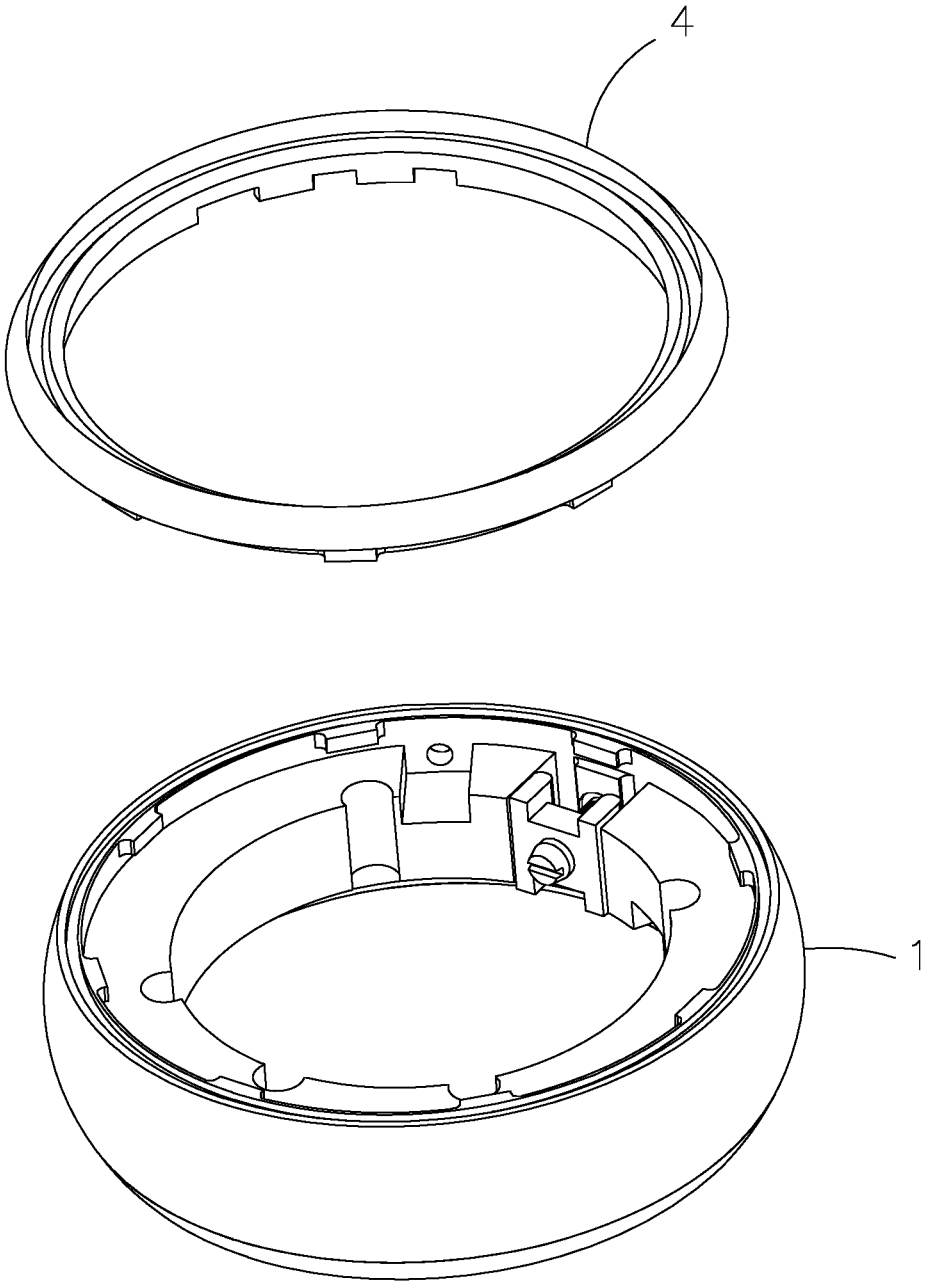
FIG. 16 is an exploded view of the embodiment of the casing and the snapping ring.
Figure 18:
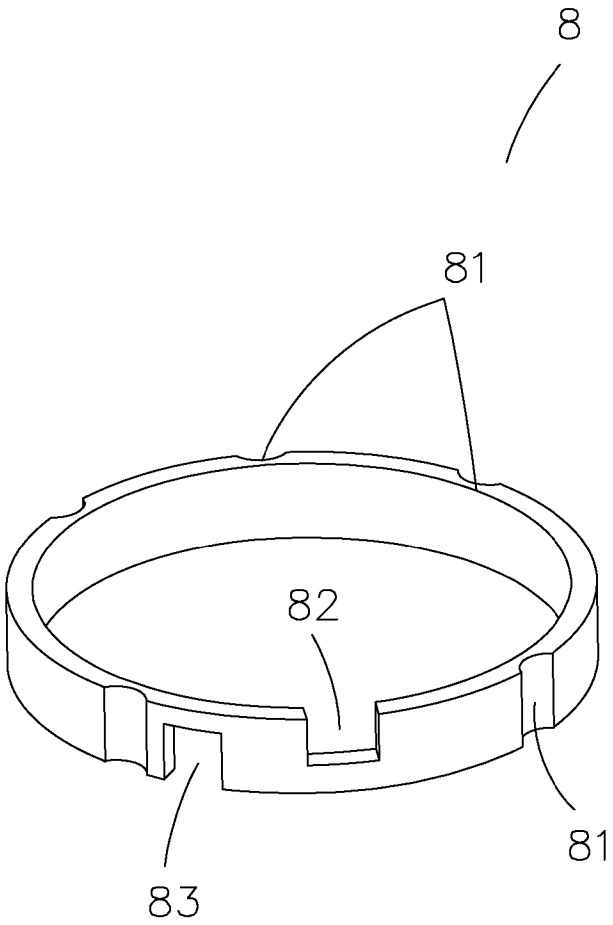
FIG. 18 is a perspective view of the second positioning ring.
Figure 17:
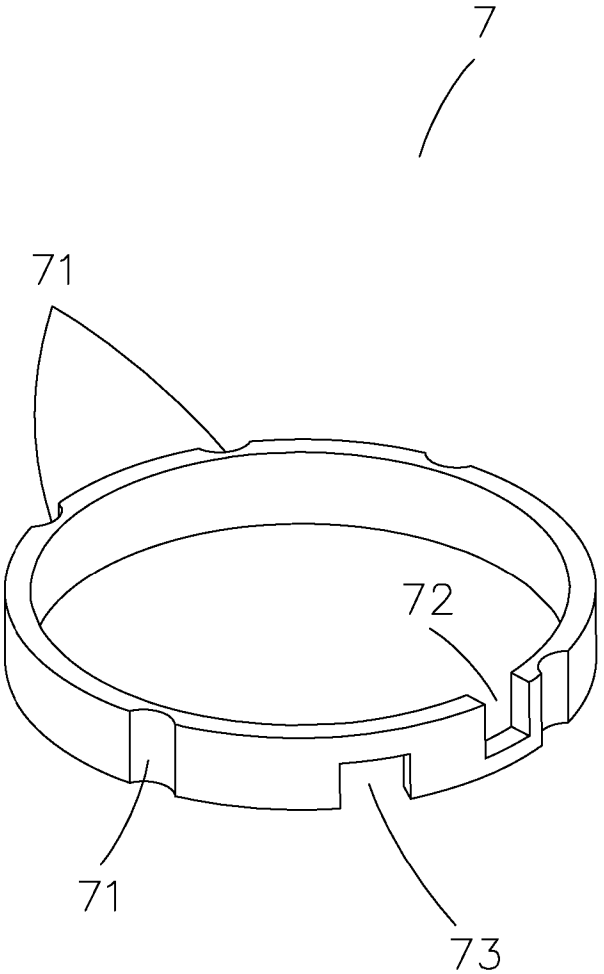
FIG. 17 is a perspective view of the first positioning ring.
Figure 19:
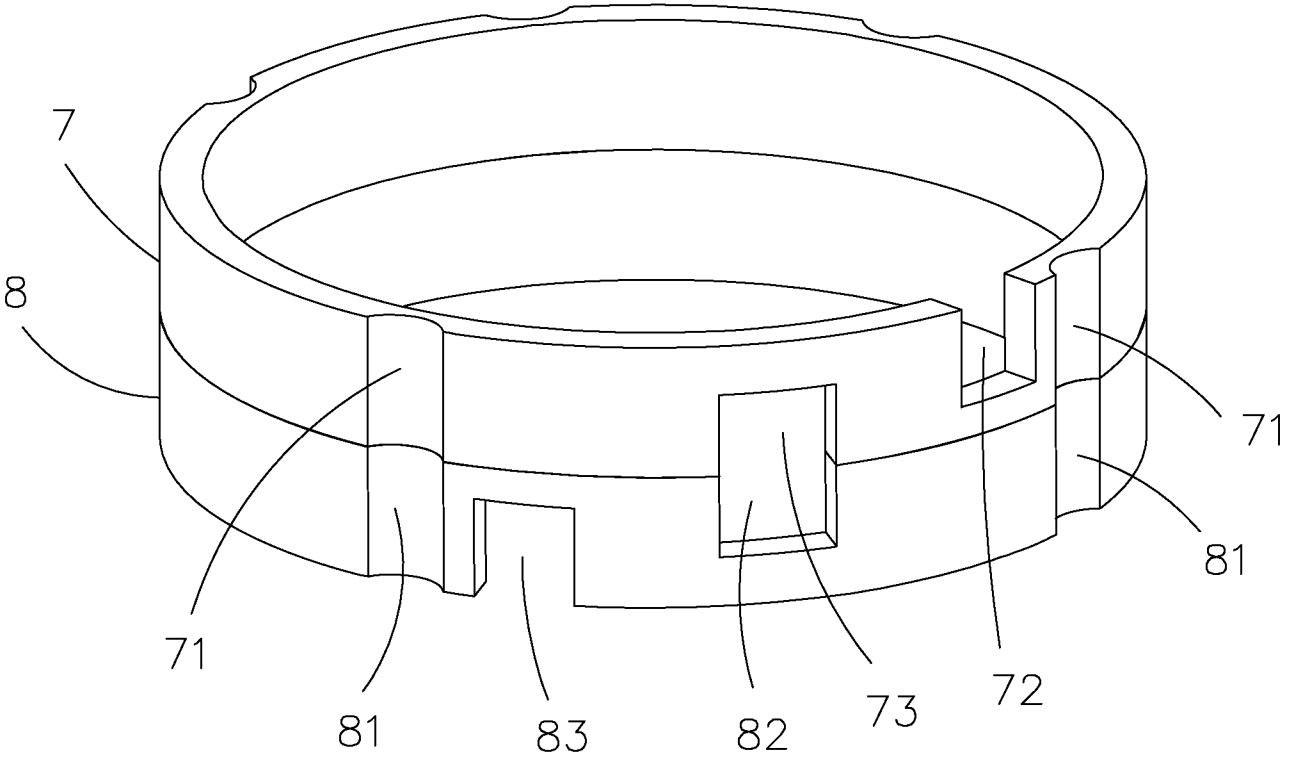
FIG. 19 is a perspective view of the embodiment of the first positioning ring and the second positioning ring assembly.
Figure 20:
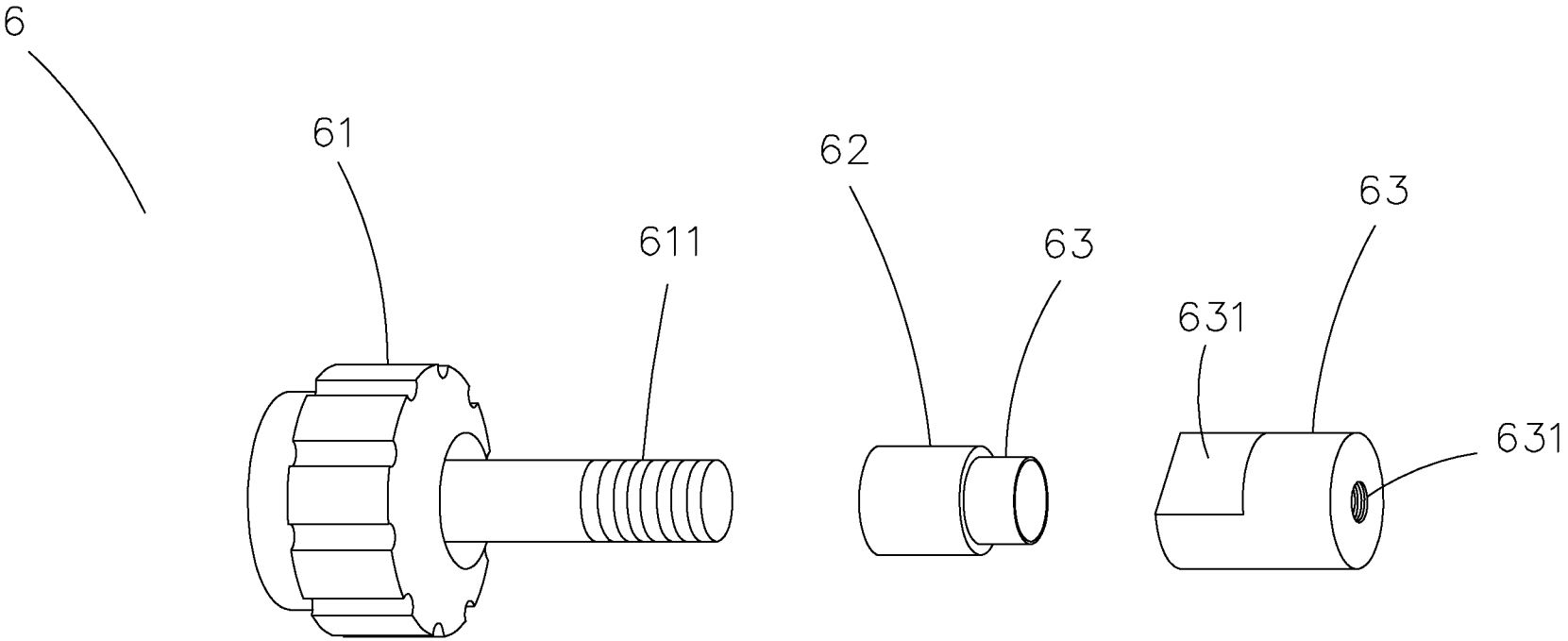
FIG. 20 is a perspective exploded view of the main adjusting assembly.
Figure 21:
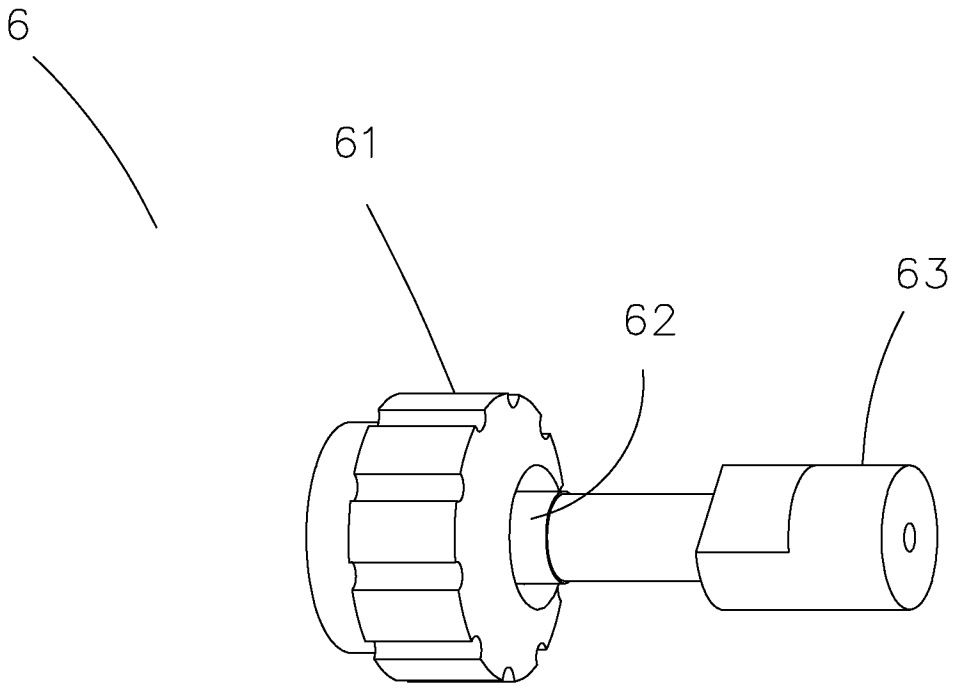
FIG. 21 is a perspective assembly view of the main adjusting assembly.
Figure 22:
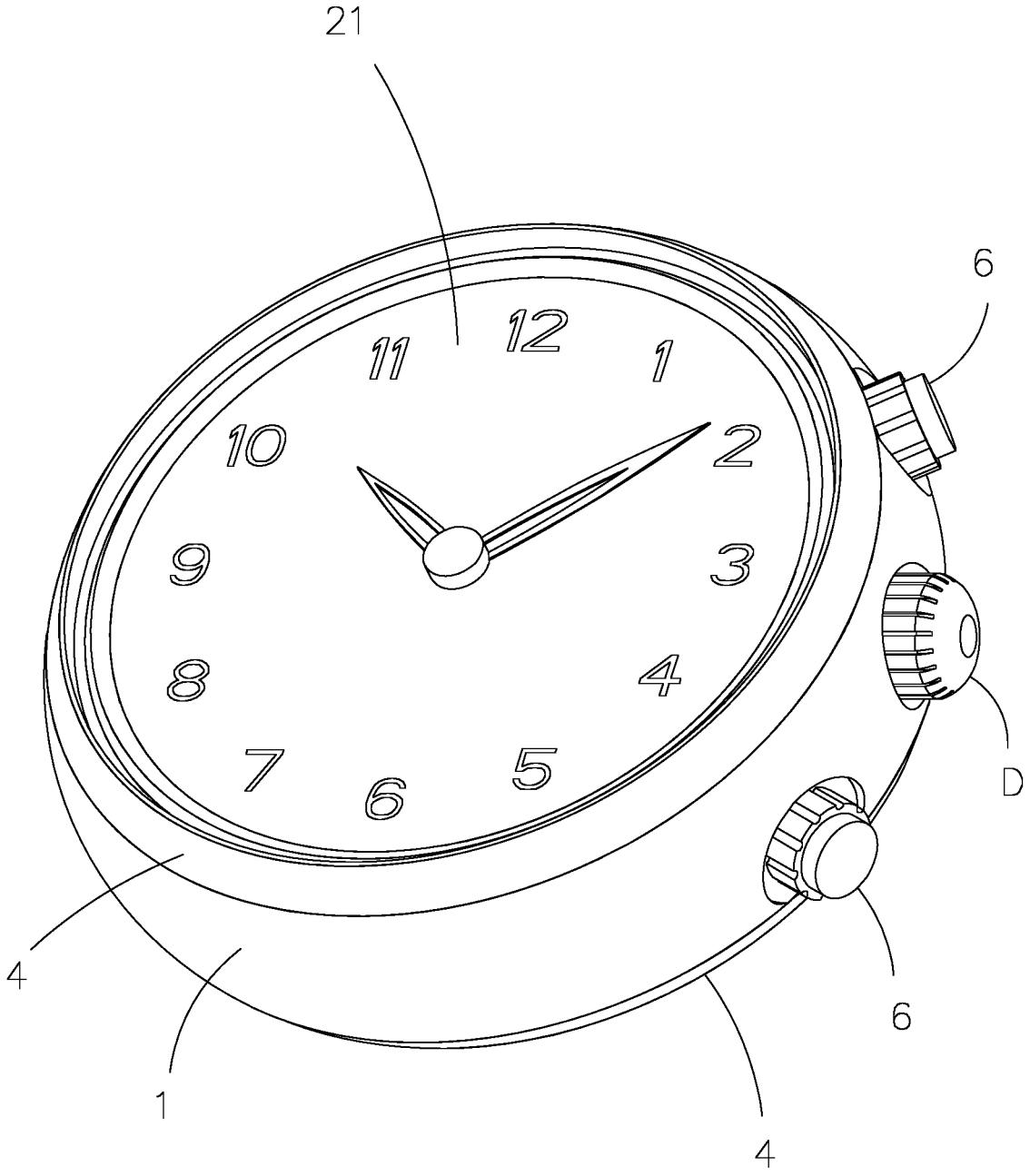
FIG. 22 is a perspective view of the embodiment of this creation (1).
Figure 23:
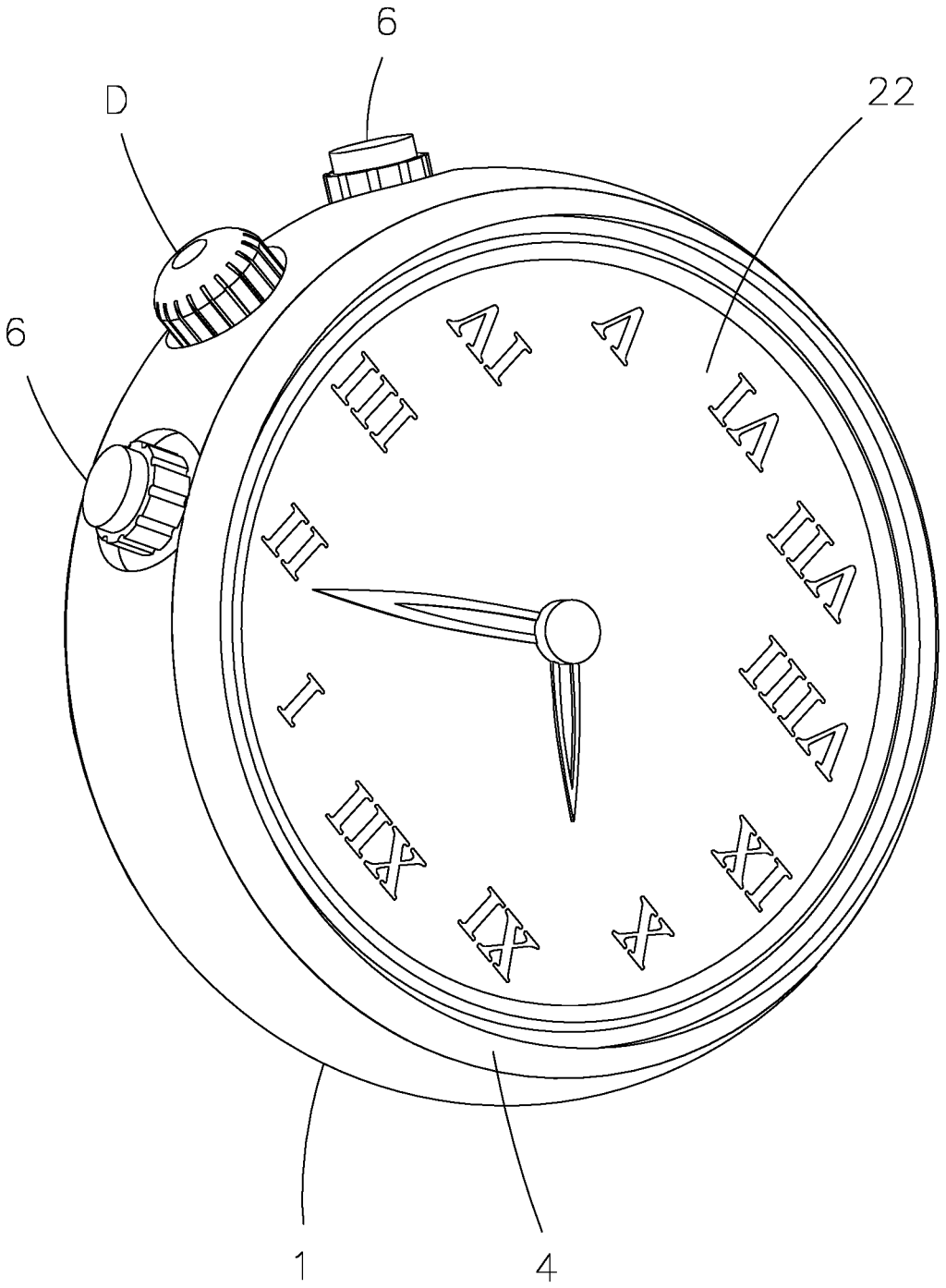
FIG. 23 is a perspective view of the embodiment of this creation (2).
Figure 24:
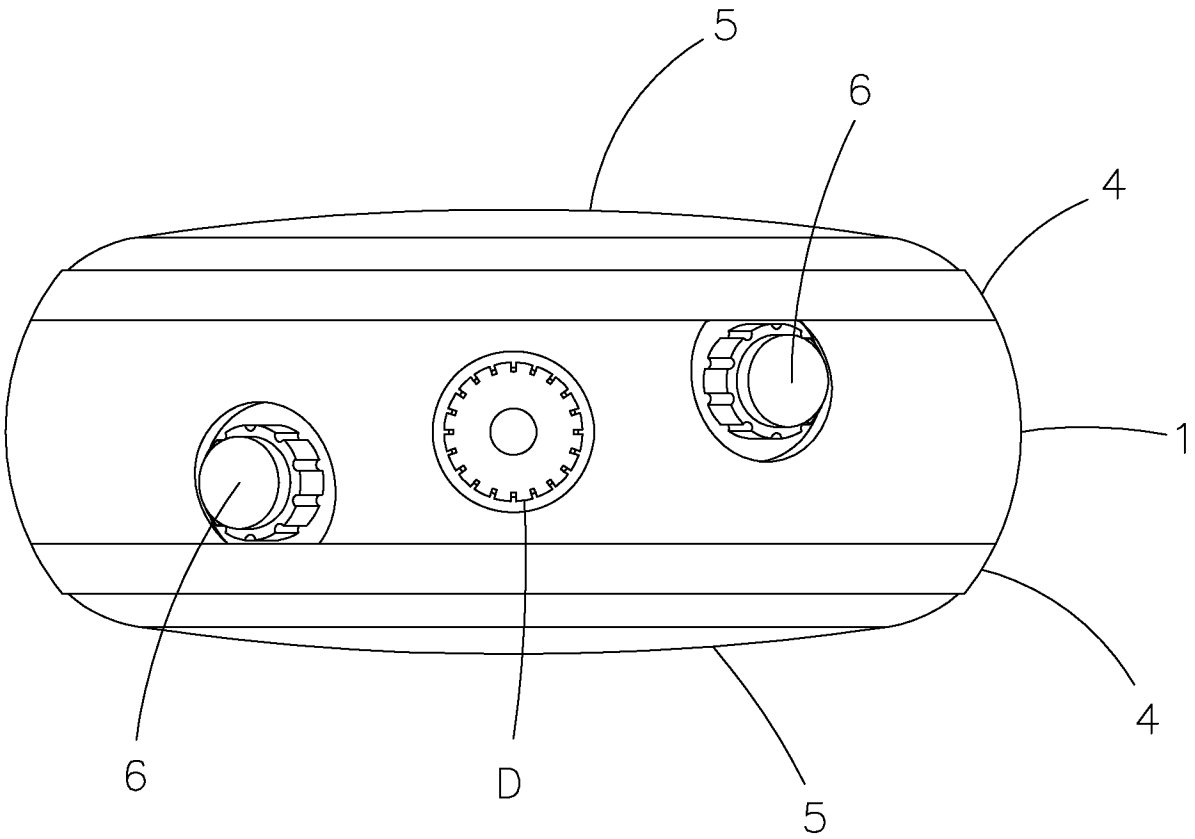
FIG. 24 is a perspective view of the embodiment of this creation (3).
Figure 25:
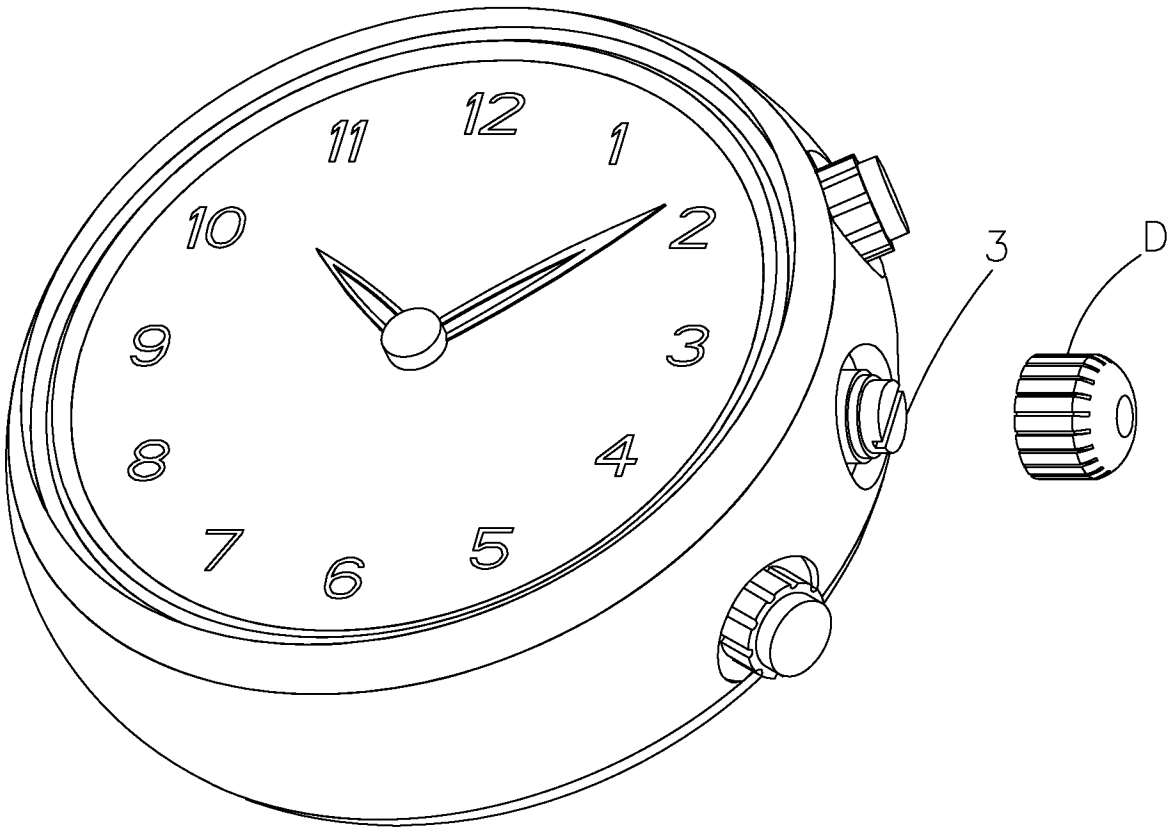
FIG. 25 is a perspective view of the embodiment of this creation (4).
Figure 26:
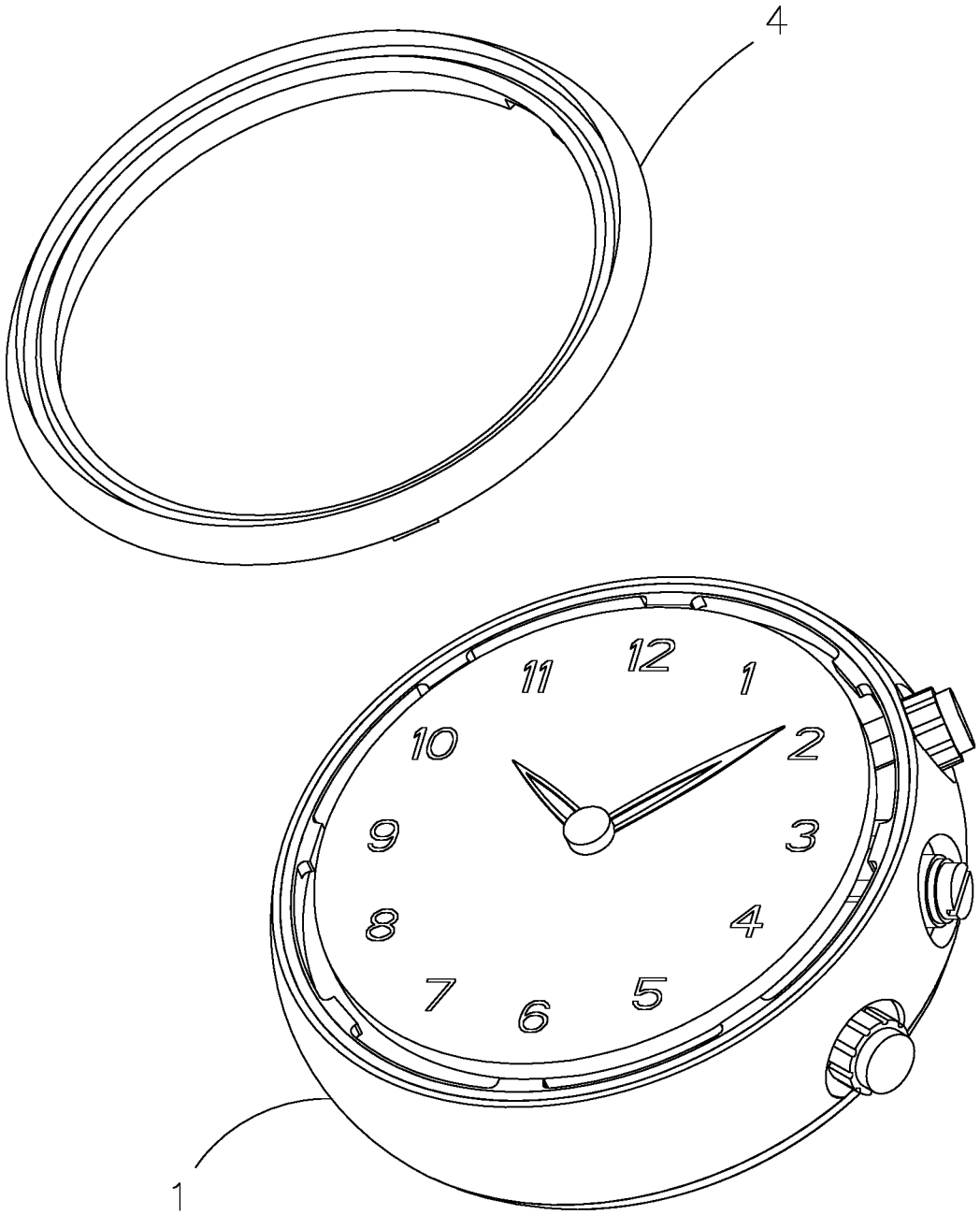
FIG. 26 is a perspective view of the embodiment of this creation (5).
Figure 27:
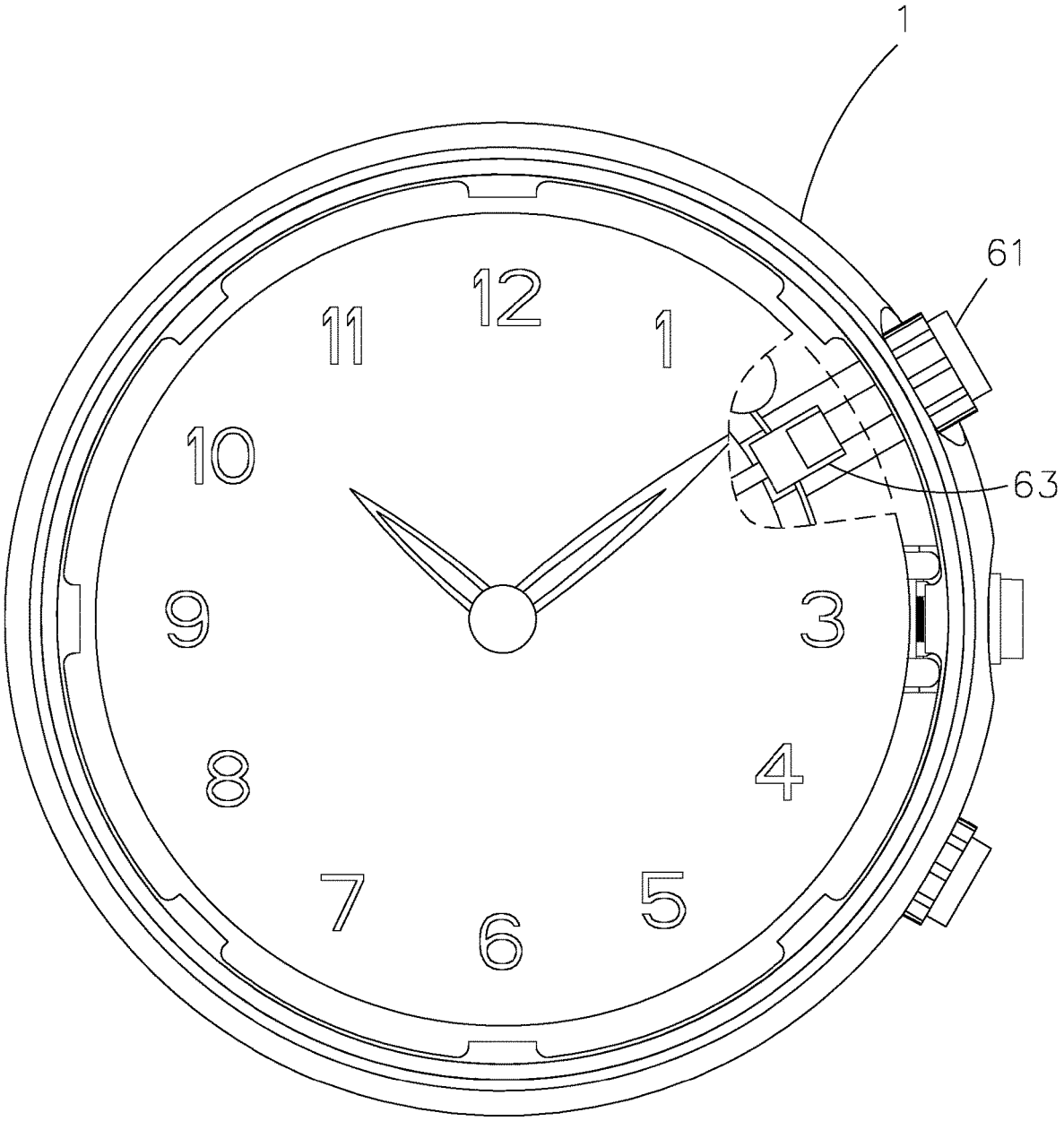
FIG. 27 is a perspective view of the embodiment of this creation (6).
Figure 28:
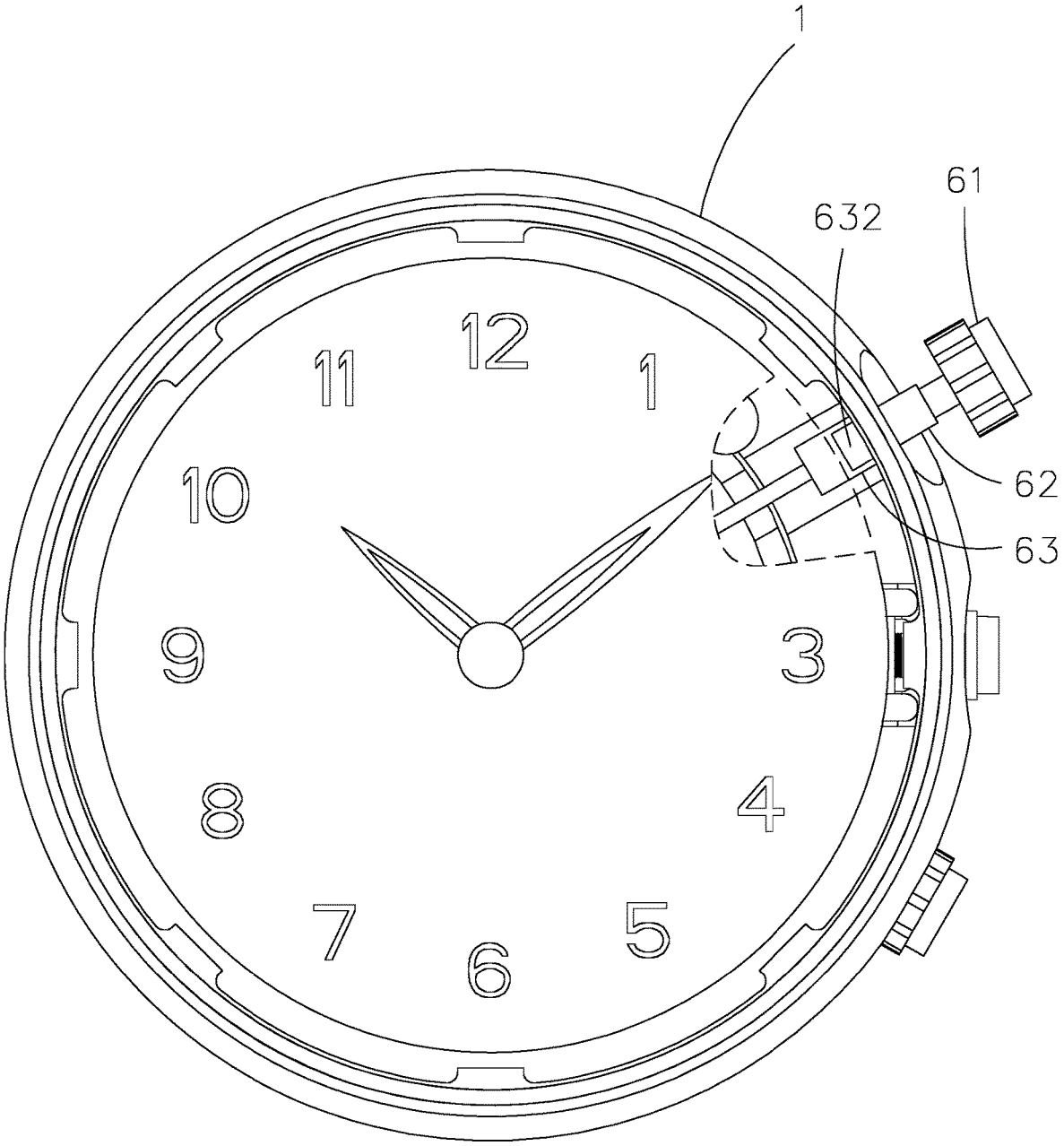
FIG. 28 is a perspective view of the embodiment of this creation (7).
Figure 29:
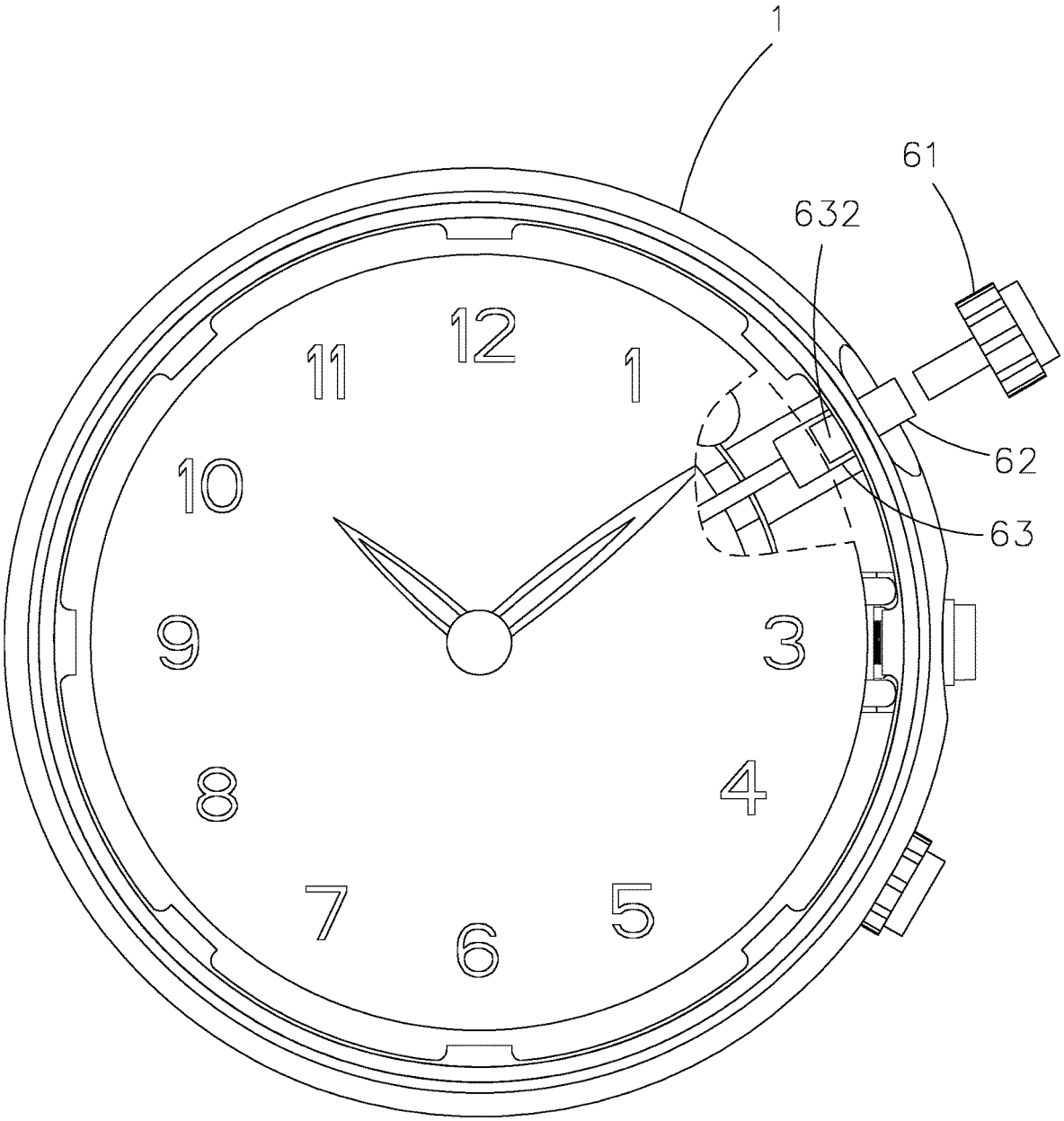
FIG. 29 is a perspective view of the embodiment of this creation (8).
Figure 30:
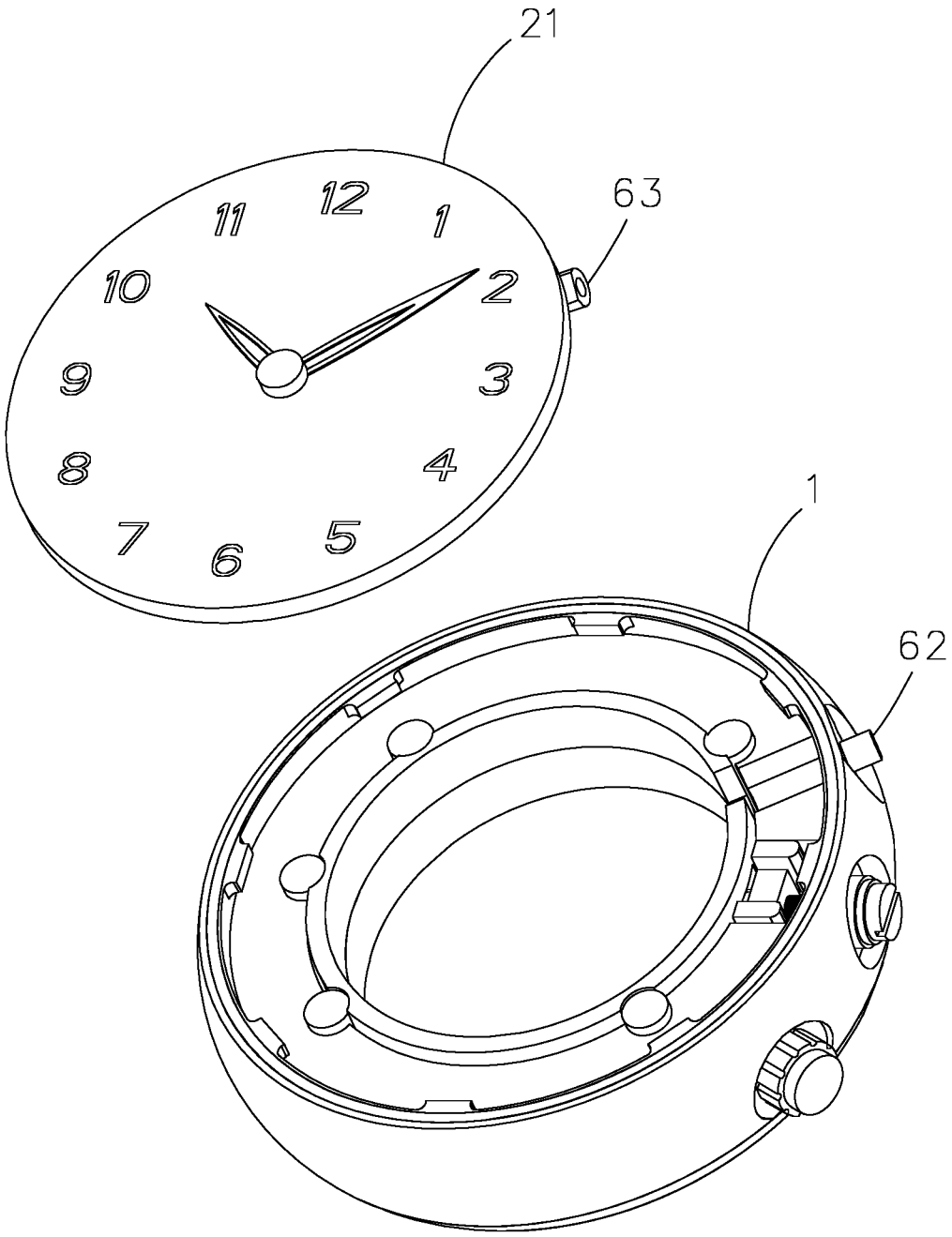
FIG. 30 is a perspective view of the embodiment of this creation (9).
Figure 31:
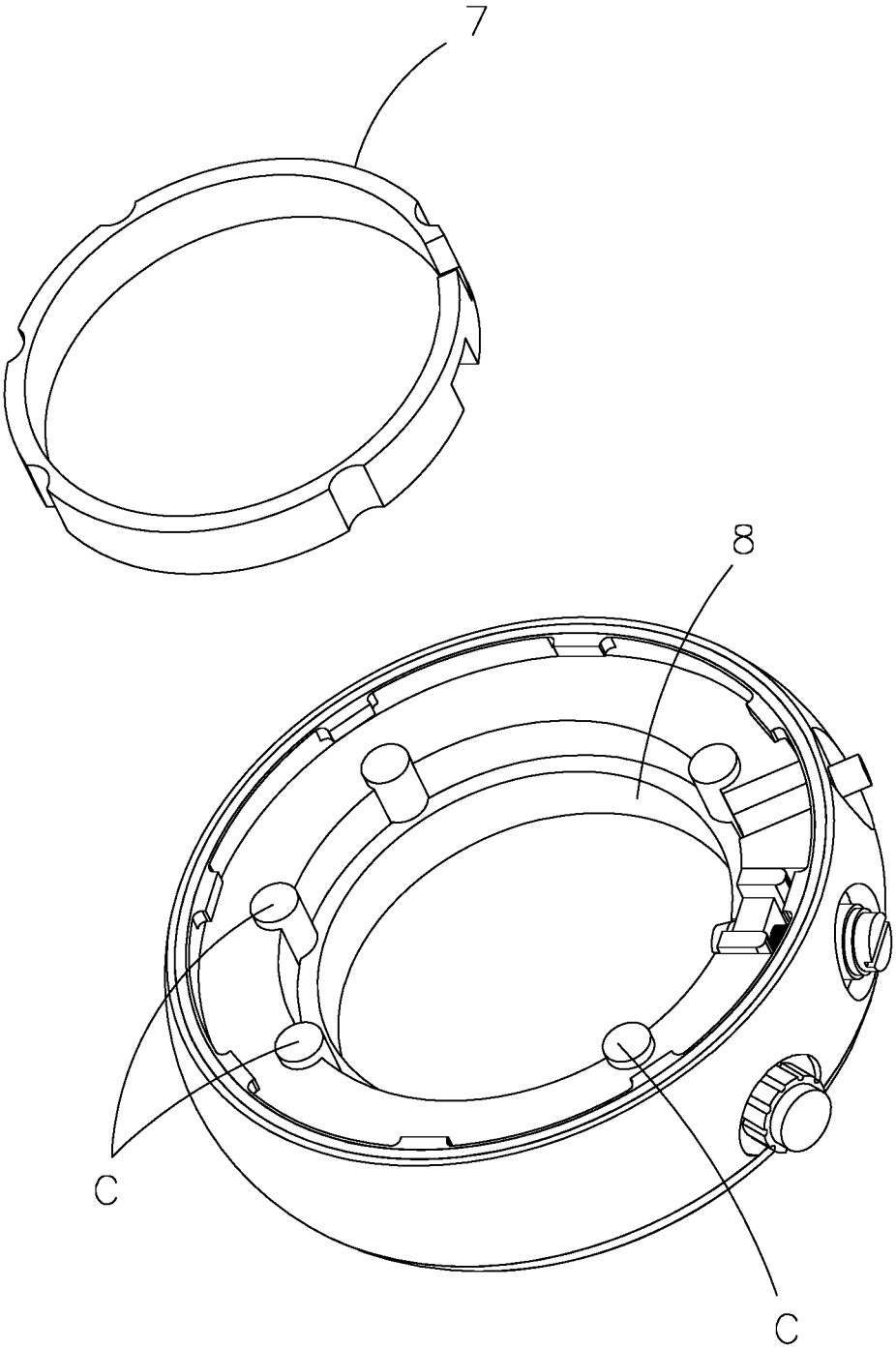
FIG. 31 is a perspective view of the embodiment of this creation (10).

Referring to FIGS. 1 to 16 of the drawings, the invention provides a watch having a double watch-surface and a method for disassembling the double watch-surface. The watch comprises a casing (1). The casing (1) is convexly provided with an abutting ring portion (11); the abutting ring portion (11) has its center being a hollow portion (12). The abutting ring portion (11) is provided with a receiving groove (13); the receiving groove (13) is arranged with a convex portion (14). The two sides of the convex portion (14) form two grooves (15) and a through hole (16) penetrating through the casing (1) and the convex portion (14). Besides, the top and bottom surfaces of the casing (1) are provided with a plurality of pressing protrusions (17) arranged at equal distance, wherein one pressing protrusion (17) is located above the receiving groove (13). An accommodating space (18) is provided between the pressing protrusion (17) and the abutting ring portion (11). A first watch-surface (21) is placed on the top of the abutting ring portion, and the movement components on the first watch-surface are located in the hollow portion (12). A second watch-surface (22) is placed on the bottom of the abutting ring portion, and the movement components on the second watch-surface are located in the hollow portion (12). An adjusting and snapping assembly (3) is composed of an adjusting screw (31), an assembly connector (32), an H-shaped snapping member (33) and an abutting screw (34). The assembly connector (32) is convexly provided with an engaging portion (321) and a threaded through hole (322), and is assembled to the through hole (16) from the outside of the casing (1) through the engaging portion (321). The adjusting screw (31) is provided with an external thread portion (311) and a hollow thread portion (312), and is screwed and assembled with the assembly connector (32) from the outside of the casing (1). The external thread portion (311) of the adjusting screw (31) is protruded from the assembly connector (32). The H-shaped snapping member (33) is provided with a threaded through hole (331) and two raised portions (332) on both sides, forming a recess (333) in the middle of the two raised portions (332). The H-shaped snapping member (33) is screwed to the external threaded portion (311) of the adjusting screw (31). The abutting screw (34) is screwed to the hollow threaded portion (312) of the adjusting screw (31). Through the forward rotation of the adjusting screw (31), the H-shaped snapping member (33) can be moved toward the convex portion (14) of the casing (1), so the two raised portions (332) are attached to the two grooves (15). When the adjusting screw (31) is reversely rotated, the two raised portions (332) are away from the two grooves (15). When the H-shaped snapping member (33) abuts against the abutting screw (34), movement stops. A snapping ring (4) is downwardly provided with a flange (41), which is provided with a plurality of engaging protrusions (42) arranged at equal distance. The flange (41) is provided with a notch (43) on both sides of one of the engaging protrusions (42). The inner ring of the snapping ring (4) is annularly provided with a pressing portion (44) and a groove (45). A transparent cover (5) is engaged with the groove (45). The two snapping rings (4) are respectively engaged with the top surface and the bottom surface of the casing (1). The snapping ring (4) is disposed on the abutting ring portion (11) through the plural engaging protrusions (42). The pressing portion (44) is pressed against the first watch-surface (21) and the second watch-surface (22) to move the engaging protrusions (42) and the two sides' notches of the snapping ring (4) onto the convex portion (14) and the two sides' grooves (15). The adjusting screw (31) is forwardly rotated to make the H-shaped snapping member (33) close to the convex portion (14), so that the two raised portions (332) pass through the two notches (43) of the snapping ring(4) and attach to the two grooves (15). The engaging protrusions (42) are located in the accommodating space (18) between the convex portion (14) and the pressing protrusion (17), and are also engaged in the recess (333) of the H-shaped snapping member (33). Other plural engaging protrusions (42) are all located under the plural pressing protrusions (17). Due to the height of the raised portions (332), the engaging protrusion (42) is unable to move left and right within the recess (333), thereby limiting the space of the engaging protrusion (42) moving left and right and achieving the effect of engaging the snapping rings (4) to the casing (1). When the snapping ring (4) needs to be disassembled, the adjusting screw (31) of the adjusting and snapping assembly (3) is reversely rotated to make the H-shaped snapping member (33) move to the center of the casing (1), making the engaging protrusion (42) no longer restricted by the two raised portions (332), thereby making the snapping ring (4) rotate laterally, so that the plural engaging protrusions (42) are detached from the accommodating space (18) without restriction by the pressing protrusion (17), so the snapping ring (4) can be dismantled from the casing (1). Moreover, the top surface and the bottom surface of the abutting ring portion (11) are provided with grooves (111), which are provided with waterproof washers (E).

Referring to FIGS. 20 to 30, the top surface and the bottom surface of the abutting ring portion (11) are further provided with a first passage portion (112) and a second passage portion (114). The first passage portion (112) and the second passage portion (114) are respectively provided with perforations (113) (115) penetrating the casing. Each of the two perforations (113) (115) is provided with a set of main adjusting assembly (6). The main adjusting assembly (6) is composed of a main screw (61), a hollow assembly connector (62) and a connecting sleeve (63). The hollow assembly connector (62) is provided with an engaging portion (621), through which the hollow assembly connector is fixed to the perforation (113) of the first passage portion (112) from the outside of the casing (1). The main screw (61) is provided with a threaded portion (611). The connecting sleeve (63) is provided with a threaded perforation (631). The main screw (61) penetrates the hollow assembly connector (62) from the outside of the casing (1) and is screwed with the connecting sleeve (63). The other end of the connecting sleeve (63) is screwed with the movement components of the first watch-surface (21) for achieving the effect of adjusting the times for the first watch-surface and for the second watch-surface by each of the main adjusting assemblies (6). Concave portions (46) are provided at positions corresponding to the relative positions of the first passage portion (112) and the second passage portion (114) of the two snapping rings.

In addition, a platform (632) is disposed at the end where the connecting sleeve (63) is assembled with the main screw (61). If one wants to disassemble the first watch-surface (21), after disassembling the snapping ring (4), a gap is left between the first watch-surface (21) and the casing (1). Pulling out the main screw (61) firstly can see the connecting sleeve (63) and the platform (632) at the gap, and using a hand tool to resist against the platform (632) and rotating the main screw (61) can disassemble the main screw (61). At this time, the connecting sleeve (63) is still connected with the movement components of the first watch-surface (21), and there is not any connecting component between the first watch-surface (21) and the casing (1), so the first watch-surface (21) can be lifted up to remove.

Referring to FIGS. 17, 18, 19, 30 and 31, the hollow portion (12) of the abutting ring portion (11) is configured with a first positioning ring (7) and a second positioning ring (8). Further, the abutment ring portion (11) is provided with a plurality of columnar grooves (19). The first positioning ring (7) and the second positioning ring (8) are provided with grooves (71) (81) corresponding to the plural columnar grooves (19), so that the plural columnar grooves (19) and the plural grooves (71, 81) are combined to form a plurality of accommodating holes. The plural accommodating holes are respectively inserted with suspension columns (C) to make this creation have shock prevention and proofing effect. The first positioning ring (7) is provided with an upper notch (72) and a lower notch (73), and the second positioning ring (8) is provided with an upper notch (82) and a lower notch (83). The lower notch (73) of the first positioning ring (7) and the upper notch (82) of the second positioning ring (8) form a window notch, wherein the upper notch (72) of the first positioning ring (7) is left with a moving space for the connecting sleeve (63) and the movement components of the first watch-surface (21), and the lower notch (83) of the second positioning ring (8) is left with a moving space for the connecting sleeve (63) and the movement components of the second watch-surface (22), and the window notch provides the moving space for the adjusting and snapping assembly (3).

As a whole, the invention restricts the movement of the snapping ring (4) on the casing (1) through the adjusting and snapping assembly (3) and changes the past dismantling process and structure of the watch. The hand tools used are simpler and less likely to damage the product itself. Through the design of two watch-surfaces, users can be more flexible to use. No matter the watch-surface style is replaced based on the occasion or traveling to different time zones for another setting, it is simpler and more convenient than the previous single surface watches, thus achieving faster and more convenient effect. It is indeed a practical and durable creation. In addition, a threaded portion (323) is provided on the outside of the assembly connector (32) of the adjusting and snapping assembly (3), and the threaded portion (323) is screwed with a decorative cover (D).

Figure 32:
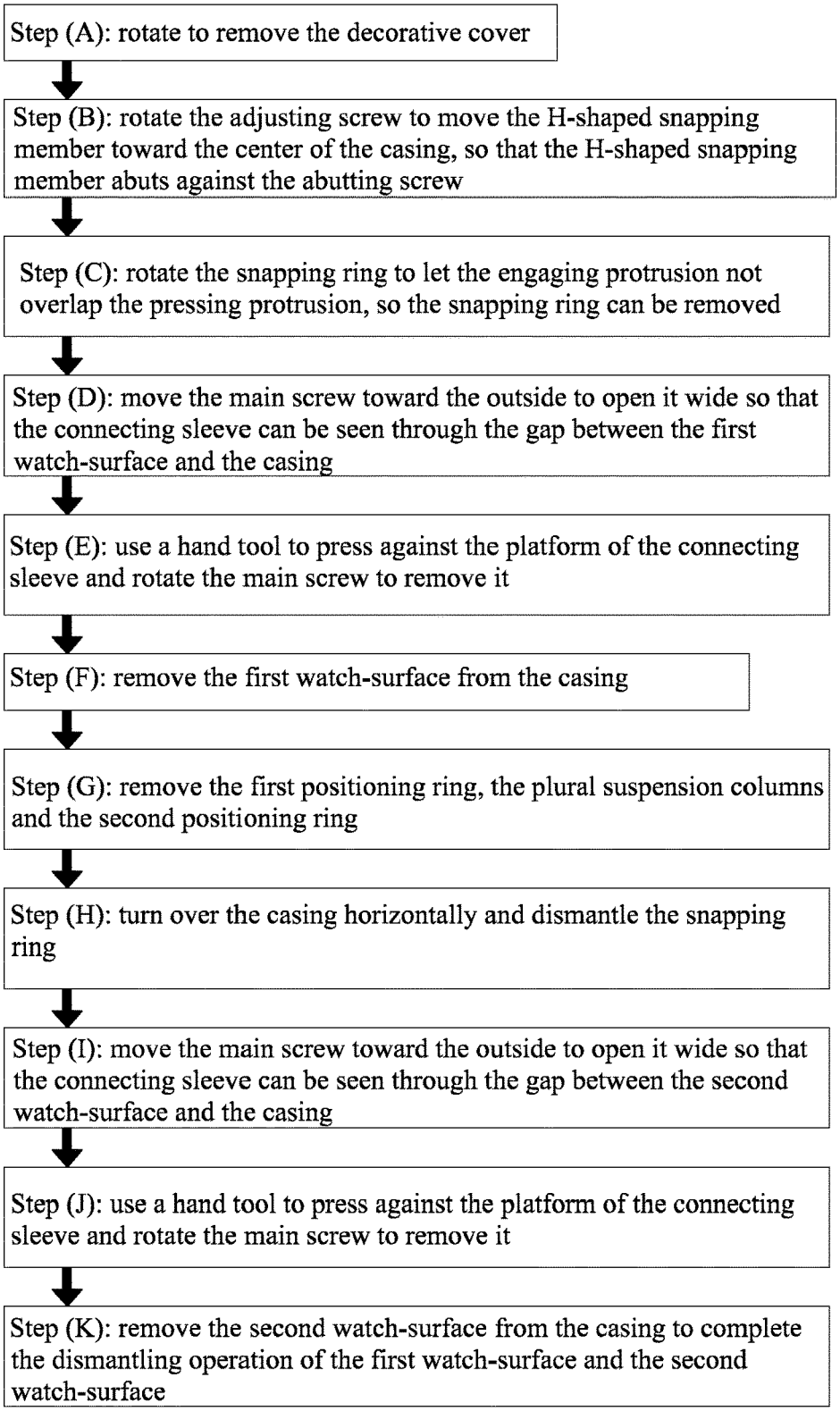
FIG. 32 is a flow chart of a method for disassembling the watch surfaces according to the invention.

Referring to FIG. 32, the steps of the method for disassembling the first watch-surface and the second watch-surface are as follows:

Step (A): rotate to remove the decorative cover (D);

Step (B): rotate the adjusting screw (31) to move the H-shaped snapping member (33) toward the center of the casing (1), so that the H-shaped snapping member abuts against the abutting screw (34);

Step (C): rotate the snapping ring (4) to let the engaging protrusion (42) not overlap the pressing protrusion (17), so the snapping ring (4) can be removed;

Step (D): move the main screw (61) toward the outside to open it wide so that the connecting sleeve (63) can be seen through the gap between the first watch-surface (21) and the casing (1);

Step (E): use a hand tool to press against the platform (632) of the connecting sleeve (63) and rotate the main screw (61) to remove it;

Step (F): remove the first watch-surface (21) from the casing (1);

Step (G): remove the first positioning ring (7), the plural suspension columns (C) and the second positioning ring (8);

Step (H): turn over the casing (1) horizontally and dismantle the snapping ring (4);

Step (I): move the main screw (61) toward the outside to open it wide so that the connecting sleeve (63) can be seen through the gap between the second watch-surface (21) and the casing (1);

Step (J): use a hand tool to press against the platform (632) of the connecting sleeve (63) and rotate the main screw (61) to remove it; and Step (K): remove the second watch-surface (22) from the casing (1) to complete the dismantling operation of the first watch-surface (21) and the second watch-surface (22).

While the invention has been described in terms of preferred embodiments, those skilled in the art will recognize that the invention can be practiced with modifications within the spirit and scope of the appended claims.

What is claimed is:

1. A watch comprising:

a casing, the casing having an abutting ring portion which protrudes inwardly and a center of the abutting ring portion being a hollow portion;

wherein the abutting ring portion is provided with a receiving groove, which is provided with a convex portion;

wherein two grooves are formed on two sides of the convex portion and a casing through hole penetrates through the casing and the convex portion;

wherein top and bottom surfaces of the casing are provided with a plurality of pressing protrusions arranged equidistant from each other, wherein a first and a second of the pressing protrusions are located above and below the receiving groove respectively;

wherein a first accommodating space is provided between the pressing protrusions on the top surface of the casing and the abutting ring portion and a second accommodating space is provided between the pressing protrusions on the bottom surface of the casing and the abutting ring portion;

a first watch-surface which is placed on a top surface of the abutting ring portion, and movement components on the first watch-surface are located in the hollow portion;

a second watch-surface which is placed on a bottom surface of the abutting ring portion, and movement components on the second watch-surface are located in the hollow portion;

an adjusting and snapping component which comprises an adjusting screw, an assembly connector, an H-shaped snapping member and an abutting screw;

wherein the assembly connector is convexly provided with an engaging portion and a threaded through hole, and is assembled to the casing through hole from an outside of the casing using the engaging portion;

wherein the adjusting screw is provided with an external thread portion and a hollow thread portion, and is screwed and assembled with the assembly connector from the outside of the casing;

wherein the external thread portion of the adjusting screw is protruded from the assembly connector;

wherein the H-shaped snapping member is provided with a threaded through hole and two raised portions on both sides, forming a top recess and a bottom recess in the middle of the two raised portions;

wherein the H-shaped snapping member is screwed to the external threaded portion of the adjusting screw;

wherein the abutting screw is screwed to the hollow threaded portion of the adjusting screw;

wherein through the forward rotation of the adjusting screw, the H-shaped snapping member can be moved toward the convex portion of the abutting ring portion to cause the two raised portions to abut against the two grooves on the two sides of the convex portion of the abutting ring portion;

wherein when the adjusting screw is reversely rotated, the two raised portions are moved away from the two grooves;

wherein when the H-shaped snapping member abuts against the abutting screw while the adjusting screw is reversely rotated, movement stops;

two snapping rings which each are downwardly provided with a flange, which is provided with a plurality of engaging protrusions arranged equidistant from each other;

wherein the flange is provided with a notch on both sides of a first protrusion of the engaging protrusions;

wherein an inner ring of each of the snapping rings is annularly provided with a pressing portion and a groove;

transparent covers which are engaged with the respective grooves of the respective snapping rings;

wherein the two snapping rings are respectively engaged with the top surface and the bottom surface of the casing;

wherein each of the snapping rings are disposed on the abutting ring portion with the plural engaging protrusions engaging the plural pressing protrusions;

wherein the pressing portion of a first of the two snapping rings is pressed against the first watch-surface and the pressing portion of a second of the two snapping rings is pressed against the second watch-surface so that the first engaging protrusion and the notches of the respective snapping rings are aligned with the convex portion and the two grooves of the abutting ring portion;

wherein when the adjusting screw is forwardly rotated to make the H-shaped snapping member close to the convex portion, the two raised portions pass through the two notches of the respective snapping rings and abut against the two grooves;

wherein the first engaging protrusions are respectively located in the first and second accommodating spaces between the convex portion and the first and second pressing protrusions, and are also respectively engaged in the top and bottom recesses of the H-shaped snapping member; and wherein other of the plural engaging protrusions are all located under other of the plural pressing protrusions, achieving the effect of engaging and fixing the two snapping rings to the casing.

2. The watch of claim 1, wherein the top surface and the bottom surface of the abutting ring portion are further provided with a first passage portion and a second passage portion;

wherein the first passage portion and the second passage portion are each provided with a perforation penetrating the casing;

wherein each of the two perforations is provided with a main adjusting assembly;

wherein each of the main adjusting assemblies comprise a main screw, a hollow assembly connector and a connecting sleeve;

wherein the hollow assembly connector is provided with an engaging portion, through which the hollow assembly connector is fixed to the perforation of the respective first passage portion or second passage portion from the outside of the casing;

wherein the main screw is provided with a threaded portion;

wherein the connecting sleeve is provided with a threaded perforation;

wherein the main screw penetrates the hollow assembly connector from the outside of the casing and is screwed with the connecting sleeve;

wherein another end of the connecting sleeve is screwed with the movement components of the respective first watch-surface or second watch-surface for achieving the effect of adjusting the times for the first watch-surface and for the second watch-surface by each of the main adjusting assemblies; and wherein concave portions are provided in the two snapping rings at positions corresponding to the relative positions of the first passage portion and the second passage portion.

3. The watch of claim 2, wherein a platform is disposed at an end where the connecting sleeve is assembled with the main screw.

4. The watch of claim 3, further comprising:

a first positioning ring, a second positioning ring, and suspension columns;

wherein the first positioning ring and the second positioning ring are provided in the hollow portion of the abutting ring portion;

wherein the abutment ring portion is provided with a plurality of columnar grooves;

wherein the first positioning ring and the second positioning ring are provided with grooves corresponding to the plural columnar grooves, so that the plural columnar grooves and the plural grooves combine to form a plurality of accommodating holes; and wherein the suspension columns are inserted in the plural accommodating holes to make this invention achieve a shock prevention and proofing effect.

5. The watch of claim 4, wherein the first positioning ring is provided with an upper notch and a lower notch, and the second positioning ring is provided with an upper notch and a lower notch; and wherein the lower notch of the first positioning ring and the upper notch of the second positioning ring form a window notch.

6. The watch of claim 5, wherein a threaded portion is provided on the outside of the assembly connector of the adjusting and snapping component, and a decorative cover is screwed on the threaded portion.

7. The watch of claim 6, wherein the top surface and the bottom surface of the casing are provided with grooves, which are provided with waterproof washers.

* * * * *